US010325742B2

(12) United States Patent
Koul et al.

(10) Patent No.: US 10,325,742 B2
(45) Date of Patent: Jun. 18, 2019

(54) HIGH PERFORMANCE SWITCH FOR MICROWAVE MEMS

(71) Applicant: Synergy Microwave Corporation, Paterson, NJ (US)

(72) Inventors: Shiban K. Koul, New Delhi (IN); Ajay Kumar Poddar, Elmwood Park, NJ (US); Sukomal Dey, New Delhi (IN); Ulrich L. Rohde, Upper Saddle River, NJ (US)

(73) Assignee: Synergy Microwave Corporation, Paterson, NJ (US)

( * ) Notice: Subject to any disclaimer, the term of this patent is extended or adjusted under 35 U.S.C. 154(b) by 0 days.

(21) Appl. No.: 15/391,289

(22) Filed: Dec. 27, 2016

(65) Prior Publication Data

US 2017/0186578 A1 Jun. 29, 2017

Related U.S. Application Data

(60) Provisional application No. 62/272,280, filed on Dec. 29, 2015.

(30) Foreign Application Priority Data

Dec. 23, 2016 (EP) ..... 16206593

(51) Int. Cl.
*H01P 1/12* (2006.01)
*H01H 59/00* (2006.01)
*H01P 3/00* (2006.01)

(52) U.S. Cl.
CPC ..... *H01H 59/0009* (2013.01); *H01P 1/127* (2013.01); *H01P 3/003* (2013.01)

(58) Field of Classification Search
CPC ..... H01P 1/12; H01H 59/0009
(Continued)

(56) References Cited

U.S. PATENT DOCUMENTS 3,454,906 A 7/1969 Hyltin et al.
3,872,409 A 3/1975 Hatkin
(Continued)

FOREIGN PATENT DOCUMENTS

CN 101090169 A 12/2007
CN 105742124 A 7/2016
EP 2493014 A2 8/2012

OTHER PUBLICATIONS

Ai Qun Liu et al, RF MEMS Switches and Integrated Switchin Circuits, Springer Science+Business Media, LLC (2010), pp. 115-132.

(Continued)

*Primary Examiner* — Dean O Takaoka
(74) *Attorney, Agent, or Firm* — Lerner, David, Littenberg, Krumholz & Mentlik, LLP

(57) ABSTRACT

The present disclosure provides for a microelectromechanical switch including a first port (e.g., input port), one or more second ports (e.g., output ports), a cantilever beam, and a mechanical spring connected to the cantilever beam for providing a mechanical force to move the cantilever beam. The cantilever beam extends from a first end, which is in contact with either the first port or one of the second ports, to a second end that is switchably connectable to the other of the first port or said one of the second ports. The first and second ports and cantilever beam may be formed in a coplanar waveguide.

37 Claims, 21 Drawing Sheets

(58) Field of Classification Search
USPC ..... 333/105, 262; 200/181
See application file for complete search history.

(56) References Cited

U.S. PATENT DOCUMENTS

| | | | | |
|---|---|---|---|---|
| 4,672,257 | A * | 6/1987 | Oota | H01H 57/00 200/181 |
| 4,806,888 | A | 2/1989 | Salvage et al. | |
| 4,931,753 | A | 6/1990 | Nelson et al. | |
| 4,977,382 | A | 12/1990 | Podell et al. | |
| 5,093,636 | A | 3/1992 | Higgins, Jr. et al. | |
| 5,168,250 | A | 12/1992 | Bingham | |
| 5,355,103 | A | 10/1994 | Kozak | |
| 5,463,355 | A | 10/1995 | Halloran | |
| 5,619,061 | A * | 4/1997 | Goldsmith | H01G 5/16 257/415 |
| 6,046,659 | A * | 4/2000 | Loo | B81B 3/0072 200/181 |
| 6,133,807 | A | 10/2000 | Akiyama et al. | |
| 6,153,839 | A * | 11/2000 | Zavracky | H01H 59/0009 200/181 |
| 6,281,838 | B1 | 8/2001 | Hong | |
| 6,307,452 | B1 * | 10/2001 | Sun | H01H 59/0009 333/262 |
| 6,356,166 | B1 | 3/2002 | Goldsmith et al. | |
| 6,509,812 | B2 | 1/2003 | Sayyah | |
| 6,531,935 | B1 | 3/2003 | Russat et al. | |
| 6,542,051 | B1 | 4/2003 | Nakada | |
| 6,621,390 | B2 * | 9/2003 | Song | H01H 59/0009 200/181 |
| 6,657,324 | B1 * | 12/2003 | Marumoto | H01H 59/00 29/846 |
| 6,741,207 | B1 * | 5/2004 | Allison | H01P 1/184 333/164 |
| 6,806,789 | B2 | 10/2004 | Bawell et al. | |
| 6,812,814 | B2 * | 11/2004 | Ma | H01H 59/0009 200/181 |
| 6,849,924 | B2 * | 2/2005 | Allison | H01H 67/22 257/635 |
| 6,853,691 | B1 | 2/2005 | Kim | |
| 6,949,985 | B2 * | 9/2005 | Qiu | H01P 1/127 333/105 |
| 6,958,665 | B2 | 10/2005 | Allison et al. | |
| 7,053,736 | B2 * | 5/2006 | Nelson | B81B 3/0054 200/181 |
| 7,068,220 | B2 | 6/2006 | DeNatale et al. | |
| 7,157,993 | B2 * | 1/2007 | DeNatale | H01P 1/127 200/181 |
| 7,259,641 | B1 | 8/2007 | Weller et al. | |
| 7,570,133 | B1 | 8/2009 | Taft et al. | |
| 7,835,157 | B2 * | 11/2010 | Tilmans | B81B 7/0006 361/760 |
| 8,451,078 | B2 * | 5/2013 | Lai | H01H 1/0036 200/181 |
| 8,581,679 | B2 * | 11/2013 | Min | H01H 1/0036 200/181 |
| 2002/0186108 | A1 | 12/2002 | Hallbjorner | |
| 2003/0102936 | A1 | 6/2003 | Schaefer | |
| 2004/0061579 | A1 | 4/2004 | Nelson | |
| 2005/0099252 | A1 | 5/2005 | Isobe et al. | |
| 2006/0109066 | A1 | 5/2006 | Borysenko | |
| 2008/0272857 | A1 | 11/2008 | Singh | |
| 2009/0074109 | A1 | 3/2009 | Foo | |
| 2012/0194296 | A1 | 8/2012 | Unlu et al. | |
| 2017/0187086 | A1 * | 6/2017 | Koul | H01P 1/182 |

OTHER PUBLICATIONS

Ashtiani et al., "Direct Multilevel Carrier Modulation Using Millimeter-Wave Balanced Vector Modulators," IEEE Transactions on Microwave Theory and Techniques, vol. 46, No. 12, Dec. 1998, pp. 2611-2619.

Barker et al., "Distributed MEMS True-Time Delay Phase Shifters and Wide-Band Switches," IEEE Transactions on Microwave Theory and Techniques, vol. 46, No. 11, Nov. 19998, pp. 1881-1890.

Barker et al., "Optimization of Distributed MEMS Transmission-Line Phase Shifters—U-Band and W-Band Designs," IEEE Transaction on Microwave Theory and Techniques, vol. 48, No. 11, Nov. 2000, pp. 1957-1966.

Chang et al., "A Tunable Broadband Photonic RF Phase Shifter Based on a Silicon Microring Resonator," IEEE Photonics Technology Letters, vol. 21, No. 1, pp. 60-62, Jan. 1, 2009.

Cho et al., "Design and fabrication of a single membrane push-pull SPDT RF MEMS switch operated by electromagnetic actuation and electrostatic hold," Journal of Micromechanics and Microengineering, vol. 20, pp. 1-7 (plus 1 page), 2010.

Choi et al., "A 5-20 GHz 5-Bit True Time Delay Circuit in 0.18 mm CMOS Technology," Journal of Semiconductor Technology and Science, vol. 13, No. 3, pp. 193-197, Jun. 2013.

De Los Santos et al., "Microwave and Mechanical Considerations in the Design of MEM Switches for Aerospace Applications," Proc. IEEE Aerospace Conf., vol. 3, pp. 235-254, 1997.

Devlin et al., "A Versatile Vector Modulator Design for MMIC," IEEE International Microwave Symposium Digest, Dallas, TX, USA, pp. 519-522, May 1990.

Dey Sukomal et al, "Reliability Analysis of Ku-Band 5-bit Phase Shifters Using MEMS SP4T and SPDT Switches", IEEE Transactions on Microwave Theory and Techniques, Dec. 2015, pp. 3997-4012, vol. 63, No. 12, IEEE Service Center, Piscataway, NJ, US.

Du Y et al, "A X-band switched-line 5-bit phase shifter with RF MEMS multithrow switches", Nano/Micro Engineered and Molecular Systems (NEMS), Apr. 2013, pp. 296-299, 2013 8th IEEE International Conference on IEEE.

Erker et al., "Monolithic Ka-Band Phase Shifter Using Voltage Tunable BaSrTiO3 Parallel Plate Capacitors," IEEE Microwave and Guided Wave Letters, vol. 10, No. 1, pp. 10-12, Jan. 2000.

European Search Report for Application No. EP16206586 dated May 12, 2017.

Extended European Search Report for Appln. No. EP16206593.2 dated May 30, 2017.

G.M. Rebeiz et al, RF MEMS—Theory, Design, and Technology, John Wiley & Sons, Inc., Hoboken, NJ, (2003) pp. 259-291 and 297-323.

Goldsmith et al., "Characteristics of Micromachined Switches at Microwave Frequencies," IEEE MTT-S Int. Microwave Symposium Digest, pp. 1141-1144, 1996.

Gong et al., "A 60-GHz 2-bit Switched-Line Phase Shifter Using SP4T RF-MEMS Switches," IEEE Transactions on Microwave Theory and Techniques, vol. 59, No. 4, pp. 894-900 Apr. 2011.

Guan-Leng Tan et al, "Low-Loss 2- and 4-bit TTD MEMS Phase Shifters Based on SP4T Switches", IEEE Transactions on Microwave Theory and Techniques, Jan. 2003, pp. 297-304, vol. 1, No. 51, IEEE Service Center, Piscataway, NJ, US.

Hacker et al., "A Ka-Band 3-Bit RF MEMS True-Time-Delay Network," IEEE Transactions on Microwave Theory and Techniques, vol. 51, No. 1, pp. 305-308, Jan. 2003.

Hayden et al., "Very Low-Loss Distributed X-Band and Ka-Band MEMS Phase Shifters Using Metal-Air-Metal Capacitors," IEEE Transactions on Microwave Theory and Techniques, vol. 51, No. 1, pp. 309-314, Jan. 2003.

Hord Jr. et al., "A New Type of Fast Switching Dual-Mode Ferrite Phase Shifter," IEEE Trans. Microwave Theory Tech., vol. 35, No. 12, pp. 985-988, Dec. 1987.

Hung et al., "Distributed 2- and 3-Bit -Band MEMS Phase Shifters on Glass Substrates," IEEE Transactions on Microwave Theory and Techniques, vol. 52, No. 2, pp. 600-606, Feb. 2004.

Hyman et al., "Surface-Micromachined RF MEMs Switches on GaAs Substrates," Int. J. RF Micrwave CAE, vol. 9, No. 4, pp. 348-361, 1999.

Jacomb-Hood et al., "A Three-Bit Monolithic Phase Shifter at V-Band," IEEE Microwave and Millimeter-Wave Monolithic Circuits Symposium Digest, pp. 81-84, Jun. 1987.

(56) References Cited

OTHER PUBLICATIONS

Kang et al., "Ku-Band MMIC Phase Shifter Using a Parallel Resonator With 0.18-"m CMOS Technology," IEEE Transactions on Microwave Theory and Techniques, vol. 54, No. 1, pp. 294-301, Jan. 2006.
Kim et al., "Linear Tunable Phase Shifter Using a Left-Handed Transmission Line," IEEE Microwave and Wireless Components Letters, vol. 15, No. 5, pp. 366-368, May 2005.
Koh et al., "0.13-mm CMOS Phase Shifters for X-, Ku-, and K-Band Phased Arrays," IEEE Journal of Solid-State Circuits, vol. 42, No. 11, pp. 2535-2546 (plus 2 pages), Nov. 2007.
Koh et al., "A 6-18 GHz 5-Bit Active Phase Shifter," IEEE MTT-S Int. Microw. Symp. Dig., Montreal, Anaheim, CA, pp. 792-795, May 2010.
Larson et al., "Microactuators for GaAs-Based Microwave Integrated Circuits," Transducers '91 Int. Cont, pp. 743-746, 1991.
Lee et al., "Low-Loss Analog and Digital Reflection-Type MEMS Phase Shifters With 1:3 Bandwidth," IEEE Transactions on Microwave Theory and Techniques, vol. 52, No. 1, pp. 211-219, Jan. 2004.
Liu A. et al., " Single-Pole-Four-Throw Switch Using High-Aspect-Ratio Lateral Switches", Electronics Letters, IEE Stevenage, GB, vol. 40, No. 18, Sep. 2, 2004, pp. 1125-1126, XP006022539, ISSN: 0013-5194, DOI: 10.1049/EL: 20045718.
Majumder et al., "Measurement and Modeling of Surface Micromachined, Electrostatically Actuated Microswitches," Tech. Digest, 1997 Int. Conf. On Solid-State Sensors and Actuators, pp. 1145-1148, Jun. 1997.
Malczewski et al., "X-Band RF MEMS Phase Shifters for Phased Array Applications," IEEE Microwave and Guided Wave Letters, vol. 9, No. 12, pp. 517-519, Dec. 1999.
Min et al., "Single-Ended and Differential Ka-Band BiCMOS Phased Array Front-Ends," IEEE Journal of Solid-State Circuits, vol. 43, No. 10, pp. 2239-2250, Oct. 2008.
Mëller et al., "Tunable Passive Phase Shifter for Microwave Applications Using Highly Anisotropic Liquid Crystals," IEEE MTT-S Int. Microw. Symp. Dig., Fort Worth, TX, USA, pp. 1153-1156, Jun. 2004.
Norris et al., "A Fully Monolithic 4-18 GHZ Digital Vector Modulator," IEEE International Microwave Symposium Digest, Dallas, TZ, USA, pp. 789-792, May 1990.
Pacheco et al., "MEMS Single-Pole Double-Throw (SPDT) X and K-Band Switching Circuits," IEEE MTT-S Int. Microwave Symposium Digest, vol. 1, pp. 321-324, 2001.
Park et al., "A 35-60 GHz Single-Pole Double-Throw (SPDT) Switching Circuit Using Direct Contact MEMS Swithces and Double Resonance Technique," 12th Int. Conf. Transducers, Solid-State Sensors, Actuators and Microsystems, vol. 2, pp. 1796-1799, Jun. 2003.
Park et al., "Electroplated RF MEMS Capacitive Switches," 13th Annual Int. Conf. on Micro Electro Mechanical Systems, pp. 639-644, 2000.
Pillans et al., "Advances in RF MEMS Phase Shifters from 15 GHz to 35 GHz," IEEE MTTT-S Int. Microw. Symp. Dig., Montreal, QC, Canada, pp. 1-3, Jun. 2012.
Pyndiah et al., "GaAs Monolithic Direct Linear (1-2.8) GHz Q.P. S.K. Modulator," 19th European Microwave Conf. Dig., London, UK, pp. 597-602, Sep. 1989.
Rebeiz et al., "RF MEMS Switches and Switch Circuits," Microwave Magazine, University of Michigan, Ann Arbor, USA, pp. 59-71, Dec. 2001.
Robert V. Garver, "Broad-Band Diode Phase Shifters," IEEE Transactions on Microwave Theory and Techniques, vol. MTT-20, No. 5, pp. 314-323, May 1972.
Scardelletti et al., "MEMS, Ka-Band Single-Pole Double-Throw (SPDT) Switch for Switched Line Phase Shifters," IEEE Antennas & Propagation Society Int. Symp., vol. 2, pp. 2-5, Jun. 2002.
Schauwecker et al., "Single-Pole-Double-Throw Switch Based on Toggle Switch," Electronic Letters, vol. 39, No. 8, pp. 668-670, Apr. 2003.
Schindler et al., "A 3 Bit K/Ka Band MMIC Phase Shifter," IEEE Microwave and Millimeter-Wave Monolithic Circuits Symposium Digest, New York, NY, USA, pp. 95-98, 1988.
Shen et al., "Low Actuation Voltage RF MEMS Switches With Signal Frequencies From 0.25GHz to 40GHz," Proc. Int. Electron Devices Meeting, pp. 689-692, 1999.
Tan et al., "Low-Loss 2- and 4-bit TTD MEMS Phase Shifters Based on SP4T Switches," IEEE Transactions on Microwave Theory and Techniques, vol. 51, No. 1, pp. 297-304, Jan. 2003.
Tang M. et al, "A Low-Loss Single-Pole-Double-Throw (SPDT) Switch Circuit", Solid-State Sensors, Actuators and Microsystems Conference, 2007. Transducers 2007. International, IEEE, Piscataway, NJ, USA, Jun. 10, 2007, pp. 679-682, XP031216121, ISBN: 978-1-4244-0841-2.
Telliez, et al., "A Compact, Monolithic Microwave Demodulator-Modulator for 64-QAM Digital Radio Links," IEEE Transactions on Microwave Theory and Techniques, vol. 39, No. 12, pp. 1947-1954, Dec. 1991.
Unlu et al., "A 15-40-GHz Frequency Reconfigurable RF MEMS Phase Shifter," IEEE Transactions on Microwave Theory and Techniques, vol. 61, No. 8, pp. 2865-2877, Aug. 2013.
Vähä-Heikkilä, et al., "RF MEMS Impedance Tuners for 6-4 GHz Applications," Int. J. RF Microw. Comput.-Aided Eng., vol. 17, No. 3, pp. 265-278, May 2007.
Yamane et al., "A Ku-band Dual-SPDT RF-MEMS Switch by Double-Side SOI Bulk Micromachining," Journal of Microelectromechanical Systems, vol. 20, No. 5, pp. 1211-1221 , Oct. 2011.
Yao et al., "Micromachined Low-Loss Microwave Switches," IEEE Journal of Microelectromechanical Systems, vol. 8, No. 2, pp. 129-134, Jun. 1999.
European Search Report for Application No. EP18189450 dated Nov. 7, 2018, 4 pages.
Schlieter DB, Henderson RM. Silicon integrated defected ground structures. InSilicon Monolithic Integrated Circuits in RF Systems (SiRF), 2010 Topical Meeting on Jan. 11, 2010 (pp. 92-95). IEEE.
Partial Search Report including Written Opinion for European Patent Application No. 18160897.7 dated Jul. 18, 2018.

* cited by examiner

HIGH PERFORMANCE SWITCH FOR MICROWAVE MEMS

CROSS-REFERENCE TO RELATED APPLICATIONS

The present application claims the benefit of the filing date of U.S. Provisional Patent Application No. 62/272,280 filed Dec. 29, 2015, and European Application No. 16206593.2 filed Dec. 23, 2016, the disclosures of which are hereby incorporated herein by reference.

FIELD OF THE TECHNOLOGY

The present disclosure relates to radio frequency (RF) switches, or more particularly to RF micro electromechanical system (MEMS) lateral switches with improved reliability and reduced risk of stiction, and to applications for the switches in switching networks.

BACKGROUND

RF MEMS switches have previously been employed in microwave and millimeter-wave communication systems, such as in signal routing for transmit and receive applications, switched-line phase shifters for phased array antennas, and wide-band tuning networks for modern communication systems. In particular, RF MEMS switches (e.g., single-pole multi-throw switches) and switching networks are broadly used in modern telecommunication systems, especially for 2G/3G/4G applications and high precision instrumentation.

FIG. 1 illustrates the circuit design of a basic single pole single throw (SPST) lateral RF MEMS switch 100. As shown in FIG. 1, the lateral switch includes a coplanar waveguide 101, a cantilever beam 140 extending between first and second ports 110, 120 of the coplanar waveguide, and an electrostatic actuator (not shown) for actuating the cantilever beam. The actuator is configured to apply a DC bias voltage between the cantilever and the ground line 130 of the coplanar waveguide 101, thereby causing the free end of the cantilever beam 140 to deflect in the direction of a fixed electrode 125. When sufficient DC bias is applied, the cantilever beam 140 deflects enough to contact a mechanical stopper of the second port, resulting in the closing (ON state) of the switch. When the DC bias is lowered or removed, the beam 140 returns to its at-rest state (as shown in FIG. 1), thereby opening the switch (OFF state).

Compared to PIN diodes or field-effect transistor (FET) switches, RF MEMS switches have been found to offer lower power consumption, higher isolation, lower insertion loss, higher linearity, and lower cost.

One drawback of the lateral switch design is that it is prone to electromechanical failure after several switching cycles, especially under hot switching conditions. For instance, the switch may fail due to static friction (or stiction) buildup between the cantilever beam and the mechanical stopper of the waveguide port. Furthermore, the spring constant of the cantilever beam is often too small to overcome the stiction. Another drawback of the lateral switch design is that, with a large number of output ports, they do not achieve a wide band performance with good repeatability, especially at lower microwave frequencies such as about 20 GHz. At lower microwave frequencies, area also plays a major role in the performance of the switch. Isolation and matching also play key roles in the switch, and the effect of isolation degrades gradually with higher number of output ports.

Therefore, there is a need to address these and other drawbacks in the field of MEMS switch design.

SUMMARY

Aspects of the present disclosure provide for an improved design of RF MEMS lateral switches that achieve improved wide band performance with improved repeatability (e.g., lifetime in the order of millions of switches) at lower microwave frequencies. Design in accordance with aspects of the disclosure include an improved RF MEMS switch that is capable of switching a large number of ports in a small chip area, thereby resulting in cost benefits, since area is directly proportional to cost in large-volume manufacturing processes.

One aspect of the present disclosure provides for a microelectromechanical switch including a first port (e.g., input port), one or more second ports (e.g., output ports), a cantilever beam, and a mechanical spring connected to the cantilever beam for providing a mechanical force to move the cantilever beam. The cantilever beam extends from a fixed end in contact with either the first port or one of the second ports, to a free end that is connectable to the other of the first port or said one of the second ports. The first and second ports and cantilever beam may be formed in a coplanar waveguide. The switch may exhibit return loss of at most about 22 dB, isolation of at most about 30 dB, and insertion loss of at most about 0.2 dB at one or more frequencies up to about 20 GHz. The total area of the switch is about 0.09 $mm^2$.

The switch may be a lateral switch, such that the mechanical spring provides a mechanical force to move the cantilever beam in a lateral direction. The mechanical spring may be configured in a semi-triangular shape. Alternatively, the mechanical spring may provide a mechanical force to move the cantilever beam in an out-of plane direction. Three mechanical springs may be utilized, each mechanical spring being connected to the cantilever beam and providing a mechanical force to move the cantilever beam. The three mechanical springs may be arranged in a Y-configuration. In any of the examples above, the mechanical spring may be actuated by an electrostatic force.

The switch may further include an actuator applying a bias voltage, whereby deflection of the cantilever beam is at least in part determined by the applied bias voltage. The actuator may be connected to a bias line. The bias line may be formed from titanium tungsten and separated from the coplanar waveguide by a layer of silicon dioxide.

Either the first port or at least one second port may include a mechanical stopper for contacting the free end of the cantilever beam, whereby when the microelectromechanical switch is open, the free end and the mechanical stopper are at a distance from one another that is greater than a distance between the mechanical spring and ground of the coplanar waveguide.

In some examples, the switch may include at least two second ports. The fixed end of the cantilever beam may be in contact with the first port, and the free end of the cantilever beam may be switchably connectable to each of said two second ports. The cantilever beam may be connected to at least two mechanical springs, each mechanical spring providing a mechanical force to move the cantilever beam towards or away from a respective one of the two second ports. The switch may exhibit return loss of at most about 25 dB, isolation of at most about 30 dB, and insertion loss of at most about 0.2 dB at one or more frequencies up to about 20 GHz.

In other examples, the switch may include at least three second ports, four second ports, six second ports, seven second ports, eight second ports, ten second ports, eleven second ports, fourteen second ports, or sixteen second ports. The switch may include as many cantilever beams as second ports. A fixed end of each cantilever beam may be in contact with a corresponding one of the second ports, and a free end of each cantilever beam may be switchably connectable to a common junction of the first port. Each cantilever beam is connected to a respective mechanical spring. The mechanical spring may providing a mechanical force to move the cantilever beam towards or away from the common junction.

In the case of a switch with three or more second ports, the switch may exhibit one of return loss of at most about 26 dB, isolation of at most about 30 dB, and insertion loss of at most about 0.22 dB at one or more frequencies up to about 20 GHz for a lateral switch configuration, or return loss of at most about 25 dB, isolation of at most about 22 dB, and insertion loss of at most about 0.35 dB at one or more frequencies up to about 12 GHz for an out-of-plane switch configuration. The total area of the switch may be about 0.43 $mm^2$.

In the case of a switch with four or more second ports, the switch may exhibit one of return loss of at most about 20 dB, isolation of at most about 30 dB, and insertion loss of at most about 0.26 dB at one or more frequencies up to about 20 GHz for a lateral switch configuration, or return loss of at most about 18 dB, isolation of at most about 20 dB, and insertion loss of at most about 0.43 dB at one or more frequencies up to about 12 GHz for an out-of-plane switch configuration. The total area of the switch may be about 0.51 $mm^2$.

In the case of a switch with six or more second ports, the switch may have a return loss of at most about 18 dB, isolation of at most about 17.5 dB, and insertion loss of at most about 0.78 dB at one or more frequencies up to about 12 GHz for an out-of-plane switch configuration. The switch may have a total area of about 0.58 $mm^2$.

In the case of a switch with seven or more second ports, the switch may exhibit one of return loss of at most about 19 dB, isolation of at most about 20 dB, and insertion loss of at most about 0.36 dB at one or more frequencies up to about 20 GHz for a lateral switch configuration; or return loss of at most about 19 dB, isolation of at most about 17.6 dB, and insertion loss of at most about 0.88 dB at one or more frequencies up to about 12 GHz for an out-of-plane switch configuration. The switch may have a total area of about 0.64 $mm^2$.

In the case of a switch with eight or more second ports, the switch may exhibit return loss of at most about 15 dB, isolation of at most about 17 dB, and insertion loss of at most about 1.0 dB at one or more frequencies up to about 12 GHz for an out-of-plane switch configuration. The switch may have a total area of about 0.68 $mm^2$.

In the case of a switch with ten or more second ports, the switch may exhibit return loss of at most about 14.7 dB, isolation of at most about 17 dB, and insertion loss of at most about 1.5 dB at one or more frequencies up to about 12 GHz for an out-of-plane switch configuration. The switch may have a total area of about 0.83 $mm^2$.

In the case of a switch with eleven or more second ports, the switch may exhibit return loss of at most about 15 dB, isolation of at most about 17 dB, and insertion loss of at most about 1.8 dB at one or more frequencies up to about 12 GHz for an out-of-plane switch configuration. The switch may have a total area of about 0.92 $mm^2$.

In the case of a switch with fourteen or more second ports, the switch may exhibit return loss of at most about 14 dB, isolation of at most about 14 dB, and insertion loss of at most about 2.2 dB at one or more frequencies up to about 12 GHz for an out-of-plane switch configuration. The switch may have a total area of about 1.2 $mm^2$.

In the case of a switch with sixteen or more second ports, the switch may exhibit return loss of at most about 14 dB, isolation of at most about 14 dB, and insertion loss of at most about 1.9 dB at one or more frequencies up to about 26 GHz for an out-of-plane switch configuration. The switch may have a total area of about 2.5 $mm^2$.

In any of the above switch configurations, the common junction may include a plurality of spokes extending radially therefrom, each spoke switchably connectable to the free ends of the respective cantilever beams. The spokes may be evenly distributed around the common junction such that each pair of adjacent spokes forms a common angle.

The present disclosure further provides for a switching network having a plurality of microelectromechanical switches as described herein. The switching network may include a plurality of single pole multiple throw switches as described herein. The switching network may be configured to operate at a frequency of up to about 20 GHz, or up to about 26 GHz.

The present disclosure yet further provides for a switch including first and second terminals, a deflectable beam connected to the first terminal and configured to deflect towards the second terminal, such that the beam contacts the second terminal when it is deflected in the direction of the second terminal, a first electrode and a mechanical spring affixed to the beam, and a second electrode spaced apart from the first electrode. A voltage applied to the second electrode causes the first electrode to move towards or away from the second electrode. When the mechanical spring is in a compressed state if the first electrode moves towards the second electrode, and returns to the at-rest state if the first electrode moves away from the second electrode. In some examples, the mechanical spring provides a force to deflect the beam towards the second terminal. In other examples, the mechanical spring provides a force to deflect the beam away from the second terminal. Also, in some examples, the first and second electrodes are spaced farther apart from one another than the first and second terminals are spaced apart.

DETAILED DESCRIPTION

Figure 1:
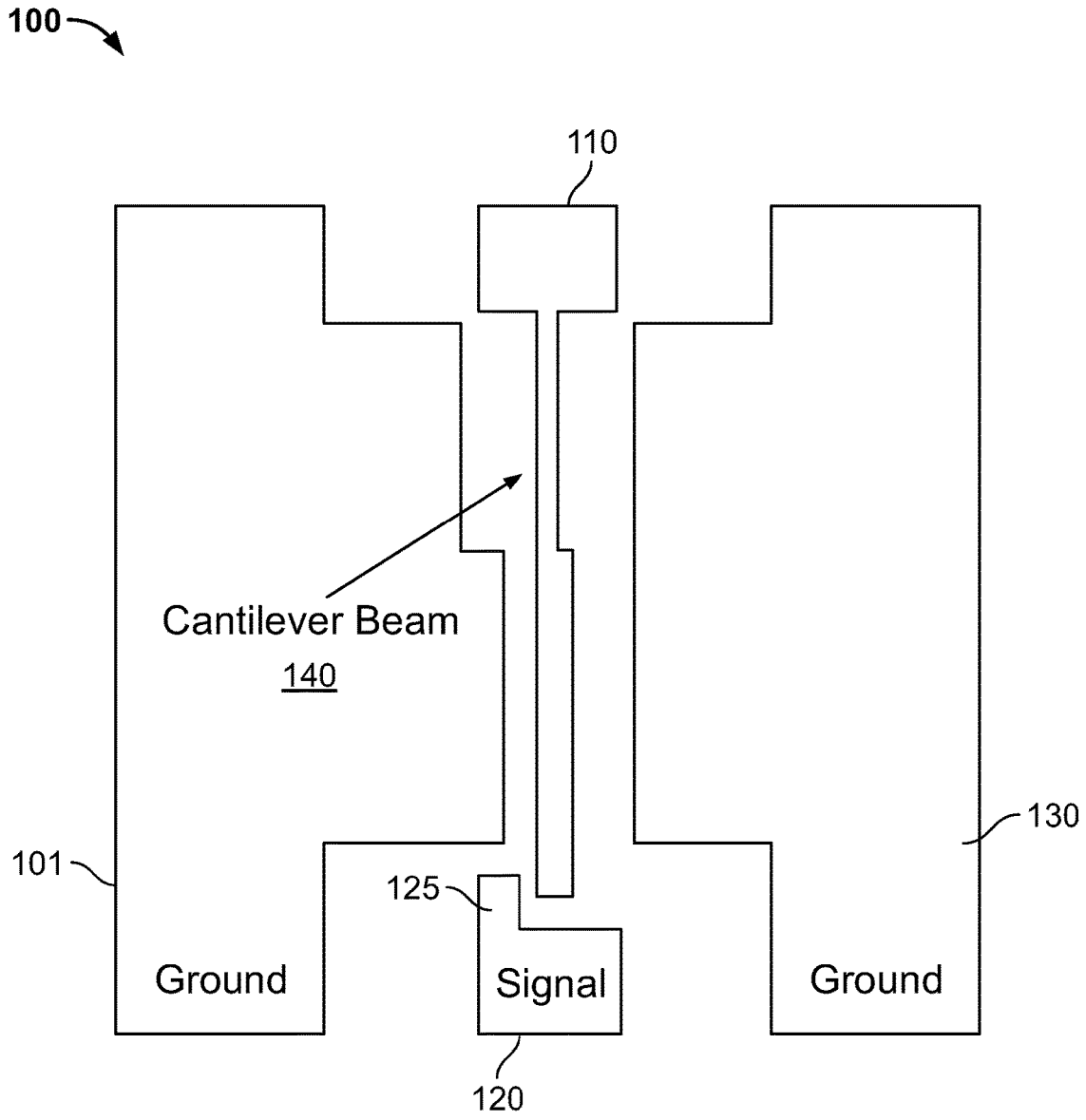
FIG. 1 Prior Art
FIG. 1 is a plan view diagram of a prior art single pole single throw (SPST) lateral switch.
Figure 2A:
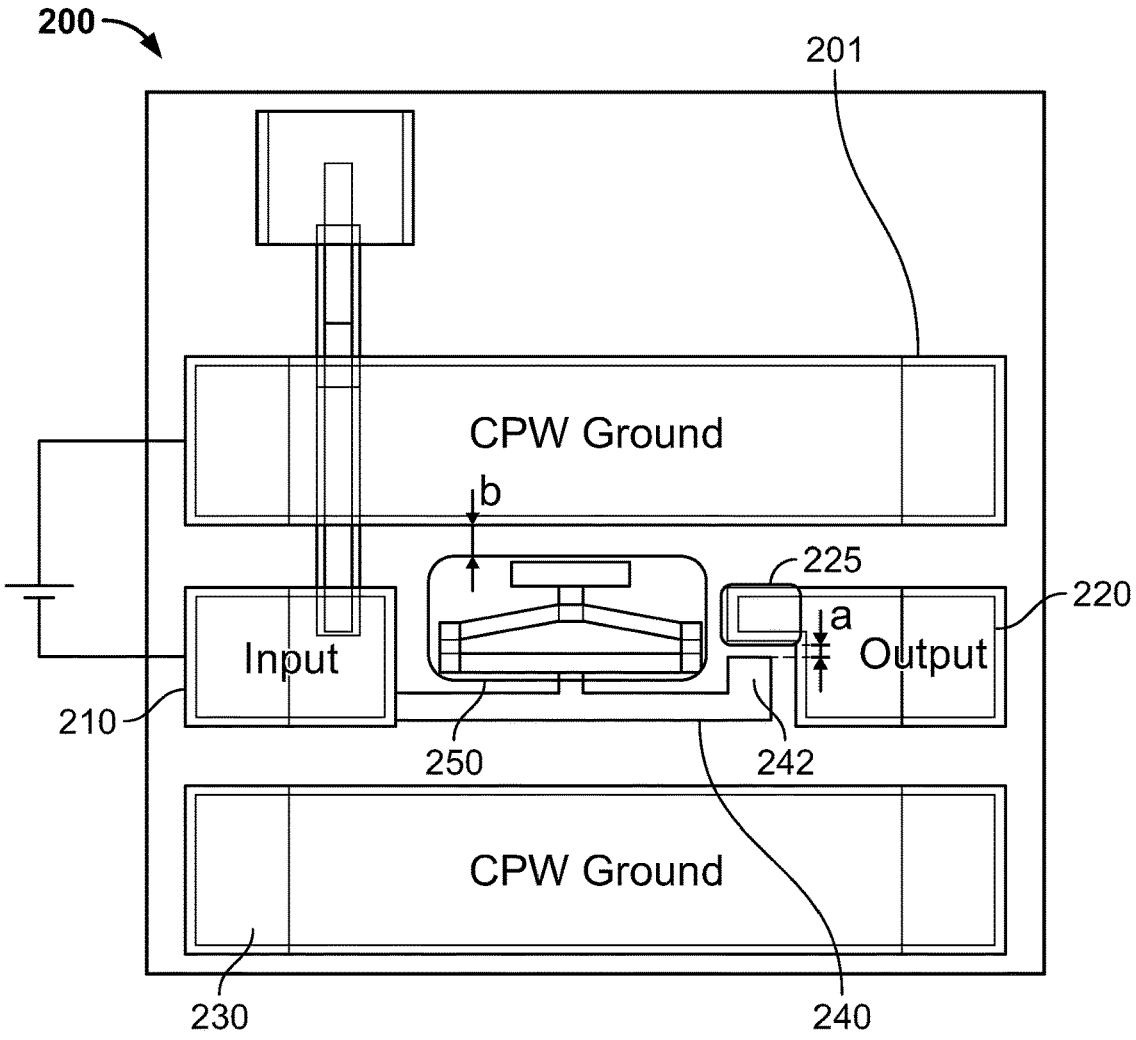
FIGS. 2A-2B and 3A-3D are plan view diagrams of an example single pole single throw (SPST) lateral RF MEMS switches in accordance with aspects of the present disclosure.
Figure 2B:
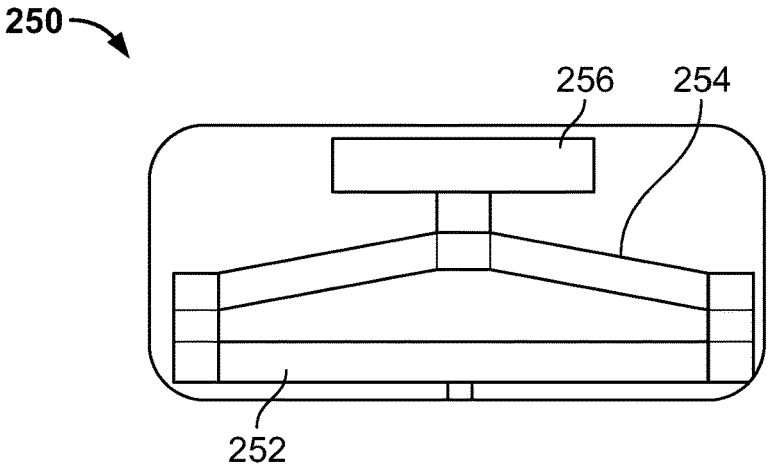

FIGS. 2A and 2B show an example RF MEMS lateral switch 200 in accordance with an aspect of the present disclosure. The lateral switch 200 includes a coplanar waveguide (CPW) 201, input and output ports 210, 220, and a cantilever beam 240 between the input and output ports. The cantilever beam 240 includes a fixed end in contact to the first port 210, and extends out from the first port towards a free end 242 that is switchably connectable to the second port 220. Also included is a mechanical spring 250, which is attached to the cantilever beam 240 between the input and output ports 210, 220. In the example of FIG. 2A, the mechanical spring 250 is attached at about mid-length or midpoint of the beam. The mechanical spring has a semi-triangular shape, and is positioned between the cantilever beam 240 and ground 230 of the waveguide. The mechanical force of the spring 250 provides an additional mechanical force to move the free end 242 of the cantilever beam 240 back to its at-rest position when the switch 200 is in an OFF state and does not contact the second port 220. In this manner, the spring provides additional assurance that the switch is returned to its at-rest state (and the cantilever beam does not remain deflected), when the switch is turned off.

The semi-triangular shape of the spring 250 is shown in greater detail in FIG. 2B. The spring 250 includes a base element 252 that is parallel to the beam 240, and two spring elements 254 that extend from the base element away from the beam, thereby substantially forming a triangle. The spring includes a contact 256 at the point where the spring elements 254 meet. The contact is parallel to the base element 252. Thus, the contact is also parallel to the CPW ground 230.

The amount of mechanical force is selected so as to overcome any potential failure of the switch due to stiction, while taking into consideration the effect of the electrostatic force induced when a bias voltage is applied. As in other in-line "DC contact" cantilever switches, electrostatic actuation between the center line and ground causes the cantilever to move in a lateral direction towards the mechanical stopper of the second port. When the cantilever moves, it is necessary that the cantilever contact the second port of the center line without the mechanical spring contacting the ground line, since contacting the ground line would result in a short circuit of the switch. Therefore, a design constraint of the present design, and particularly of the mechanical spring, is that the at-rest distance between the free end of the cantilever beam 242 and the mechanical stopper 225 of the second port 200 ("a" in FIG. 2A) should be significantly less than the distance between the contact 256 of the mechanical spring 250 and the CPW ground 230 ("b" in FIG. 2A), so that when a DC bias is applied, the free end of the cantilever beam 242 contacts the mechanical stopper 225 without the mechanical spring contact 256 contacting the ground line 230.

Figure 3A:
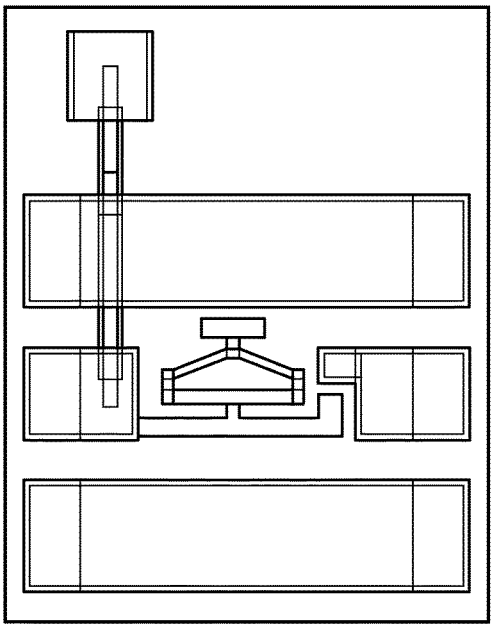
Figure 3B:
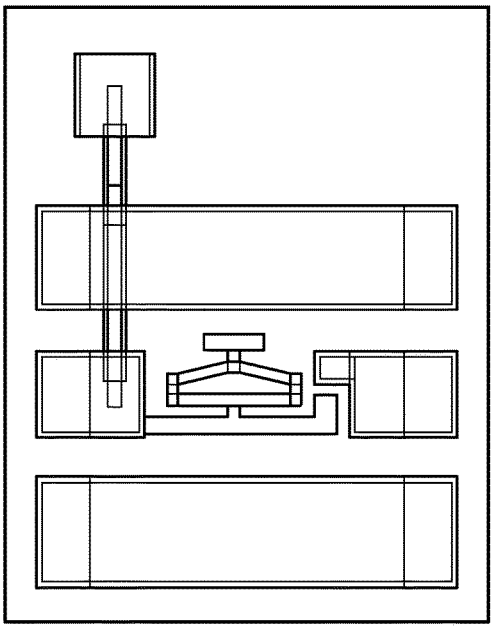
Figure 3C:
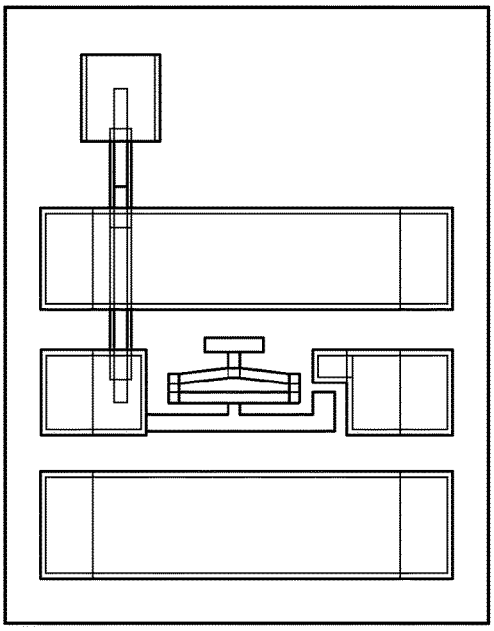
Figure 3D:
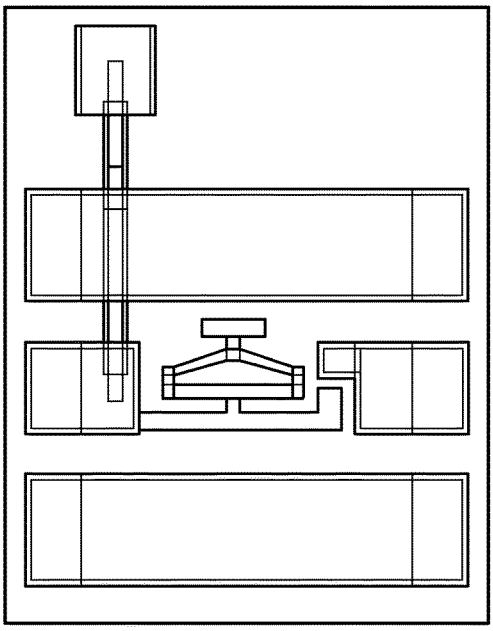
Figure 4A:
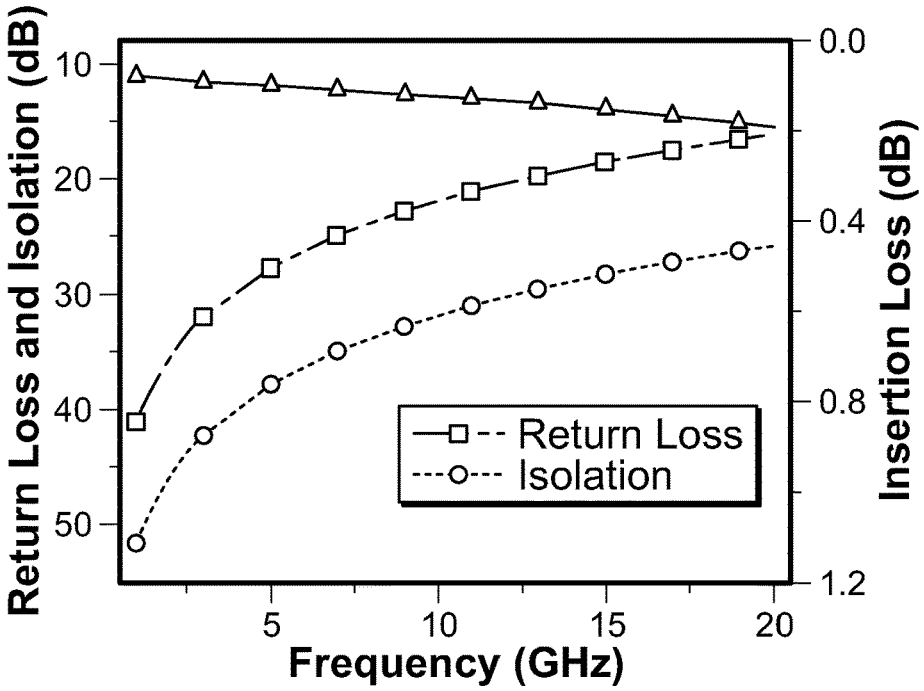
FIGS. 4A-4D are graphical representations of return loss, isolation, and insertion loss for each of the example lateral switch designs of FIGS. 3A-D, respectively.
Figure 4B:
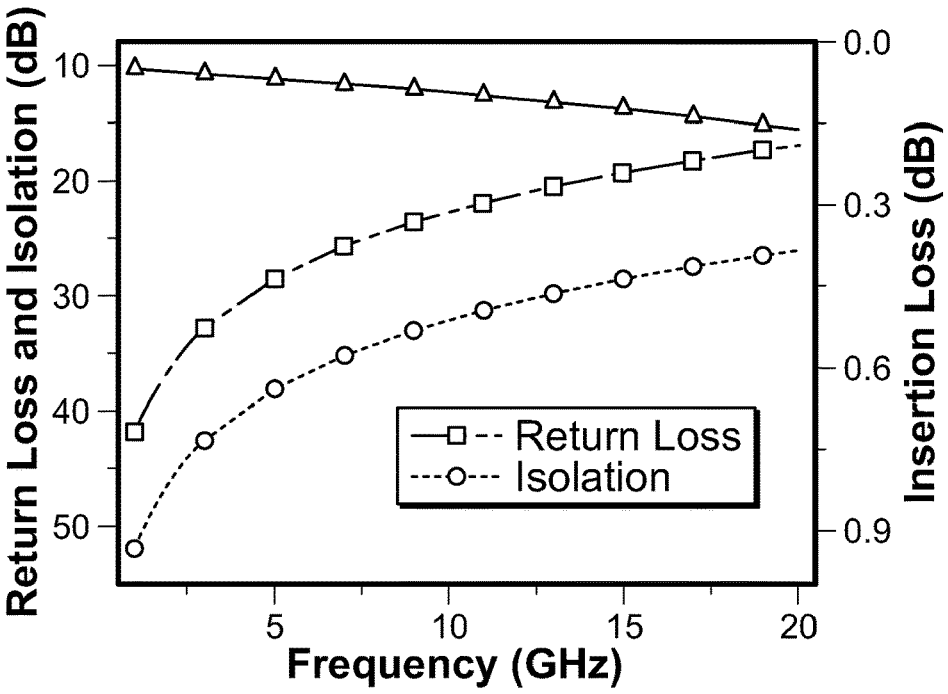
Figure 4C:
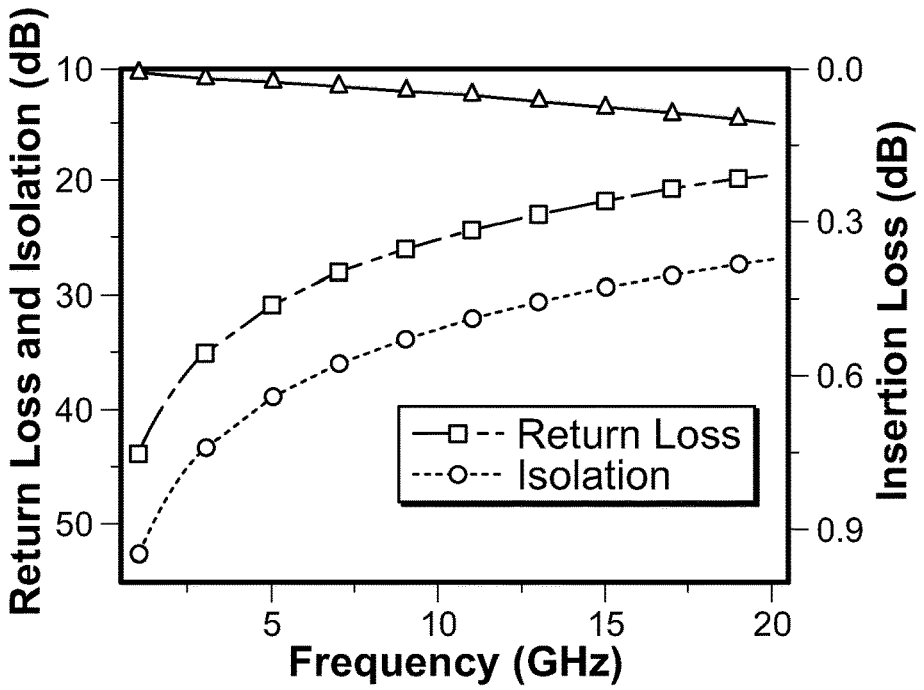
Figure 4D:
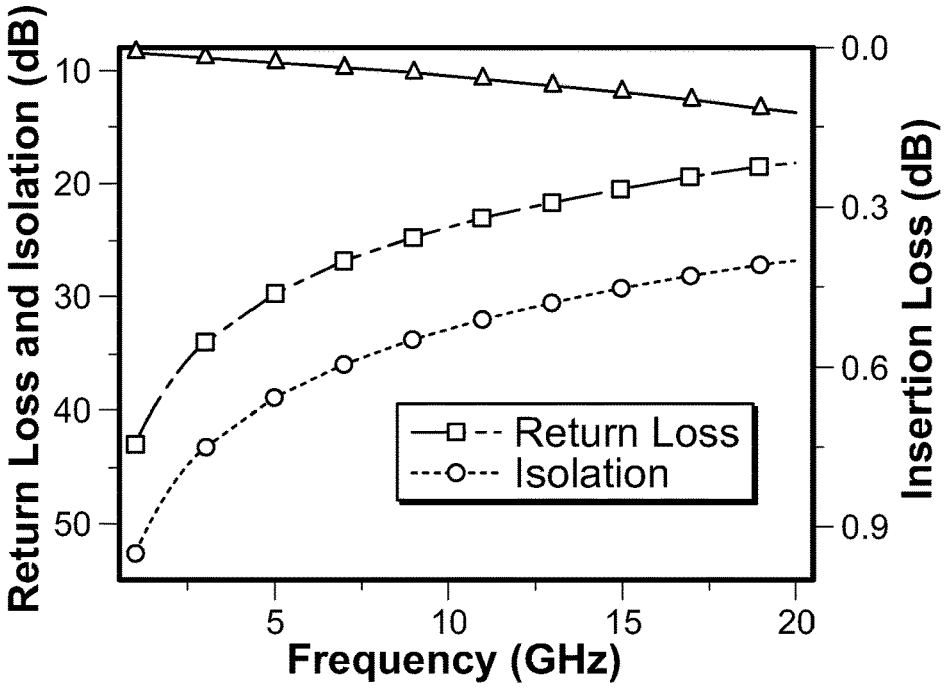

FIGS. 3A-D show four example RF MEMS lateral switches in accordance with some aspects of the present disclosure. Each of the examples of FIGS. 3A-D show designs similar to that of FIGS. 2A-2B, except that the properties of the mechanical spring in each design are different. For example, the mechanical spring of the example of FIG. 3C is notably flatter than the other designs, whereas the mechanical spring of the example of FIG. 3A is notably more triangular. The tension of the mechanical springs may also vary between the designs, although the geometry and tension of the spring may be mutually exclusive. In this regard, the mechanical spring in the example of FIG. 3C exhibits greater stability or lifetime (e.g., over numerous switching cycles) as compared to the springs of the other designs.

The different lateral switch designs of FIGS. 3A-D may be selected from based on the varying performance provided by each design. FIGS. 4A-D show return loss, isolation, and insertion loss for each of the example designs of FIGS. 3A-D, respectively. As shown in the figures, simulations of the SPST switch show return loss of better than between about 18-22 dB, isolation of about 30 dB, and worst case insertion loss of about 0.13-0.2 dB at frequencies of up to about 20 GHz.

The switches of FIGS. 2 and 3A-D reduce or eliminate the risk of mechanical failure due to dielectric charging, and are capable of operating within a point of stability. Thus, the switches are capable of improving RF power handling under both cold-switching and hot-switching conditions. Moreover, due to the electrostatic actuation of the switch, the cantilever of the switch may be designed with increased stiffness. The cantilever may also be less sensitive to stresses due to its small size and shortened switching time. The switch may also be less sensitive to planarity and stress which significantly improves the overall contact force. The reduced sensitivity in turn improves overall yield.

Figure 5:
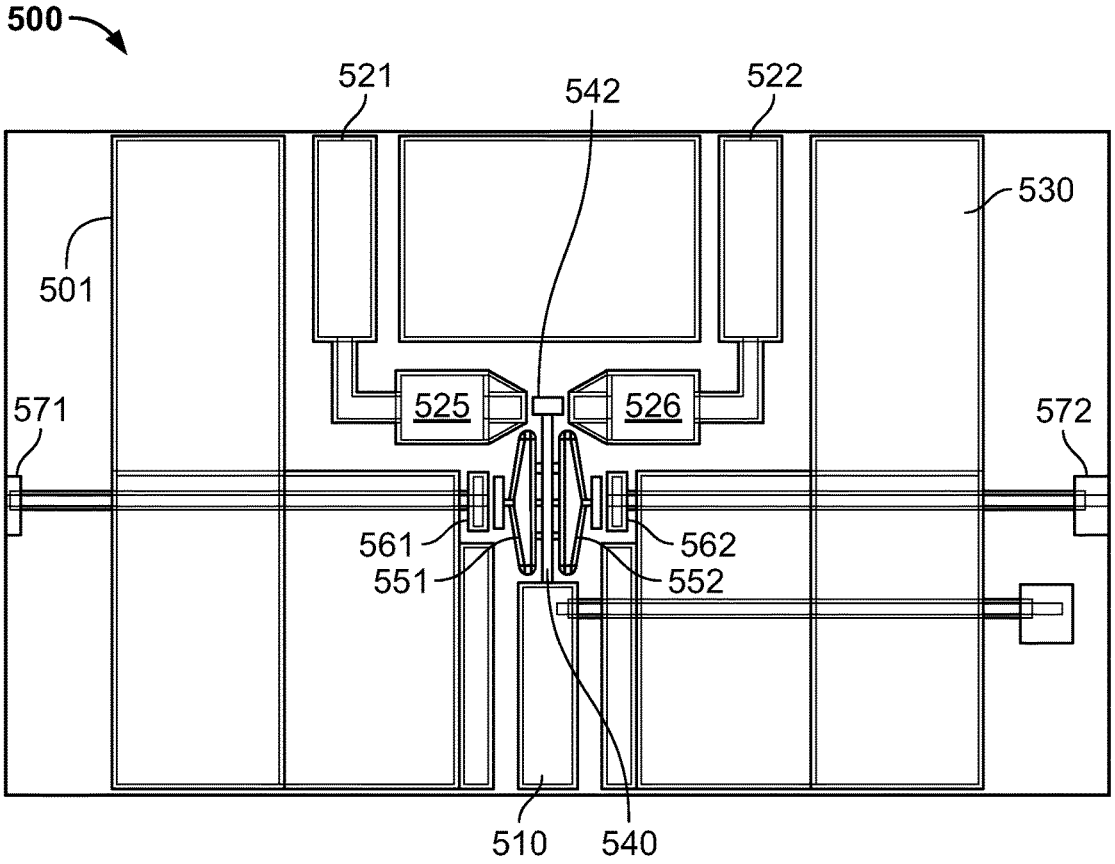
FIG. 5 is a plan view diagram of a single pole double throw (SPDT) lateral switch in accordance with aspects of the present disclosure.

The example design of FIG. 2A is a single pole single throw (SPST) switch. However, the design of single pole multiple throw (SPMT) switches may be improved in a similar fashion. FIG. 5 shows an example RF MEMS single pole double throw (SPDT) lateral switch 500 in accordance with an aspect of the present disclosure. The SPDT switch 500 includes a coplanar waveguide 501 including an input port 510, first and second output ports 521, 522, and a single cantilever beam 540 positioned to couple the input port 510 with either one of the output ports 521, 522 depending on the direction of lateral deflection of the cantilever beam 540. Two mechanical springs 551, 552 are laterally attached to opposing sides of the cantilever beam 540. The free end of the cantilever beam 542 is positioned to be able to deflect in either lateral direction so as to come in contact with a contact bump 525, 526 (comparable to the mechanical stopper shown in FIG. 2A) of either the first output port 521 or the second output port 522, depending on the direction in which the cantilever beam deflects. Deflection is determined based on the bias voltage applied to the actuators 561, 562 from each of the bias pads 571, 572. The bias voltage applied at an actuator causes an electrode at the switch to move towards or away from the actuator, thereby either deflecting the cantilever beam toward the output port, or releasing the cantilever beam so that it moves away from the output port. At a given time, one of the actuators may be "ON," while the other is "OFF." Actuation and release of the cantilever beam 540 may aided by the mechanical spring 551, 552 on the side of the beam to which the beam deflects. Effectively, the SPDT switch 500 operates in the same fashion as the SPST switch 200 of FIG. 2A, except that the SPST switch beam 240 operationally closes and opens a switch in only one direction, whereas the SPDT switch beam 540 operationally closes and opens a switch in two opposing directions.

Figure 6A:
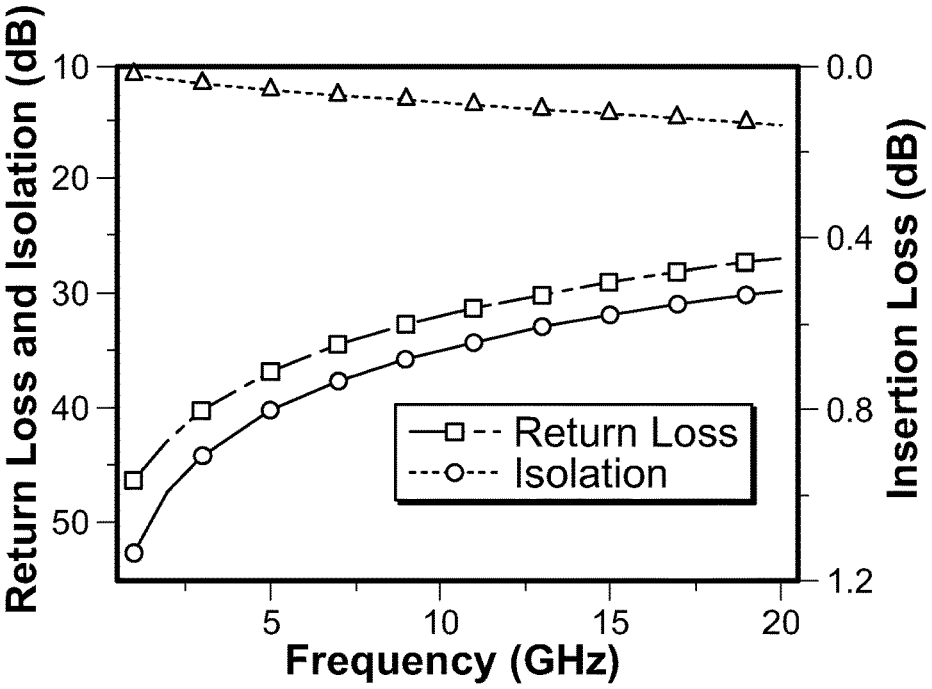
FIGS. 6A-6B are graphical representations of return loss, isolation, and insertion loss for the lateral switch of FIG. 5.
Figure 6B:
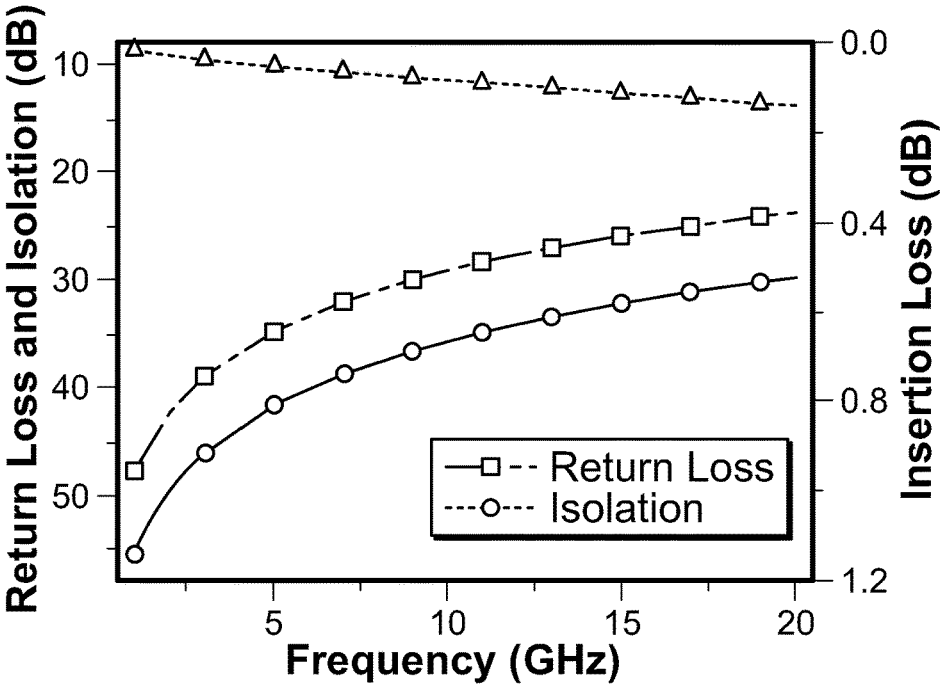

FIGS. 6A-B show simulated return loss, isolation, and insertion loss for each of output ports 521 and 522, respectively, for the example SPDT lateral switch design of FIG. 5. As shown in the figures, the SPDT switch exhibits return loss of better than about 25 dB, isolation (e.g., of one port when another port is activated) by about 30 dB or greater, and worst case insertion loss of about 0.2 dB at frequencies of up to about 20 GHz.

Figure 7:
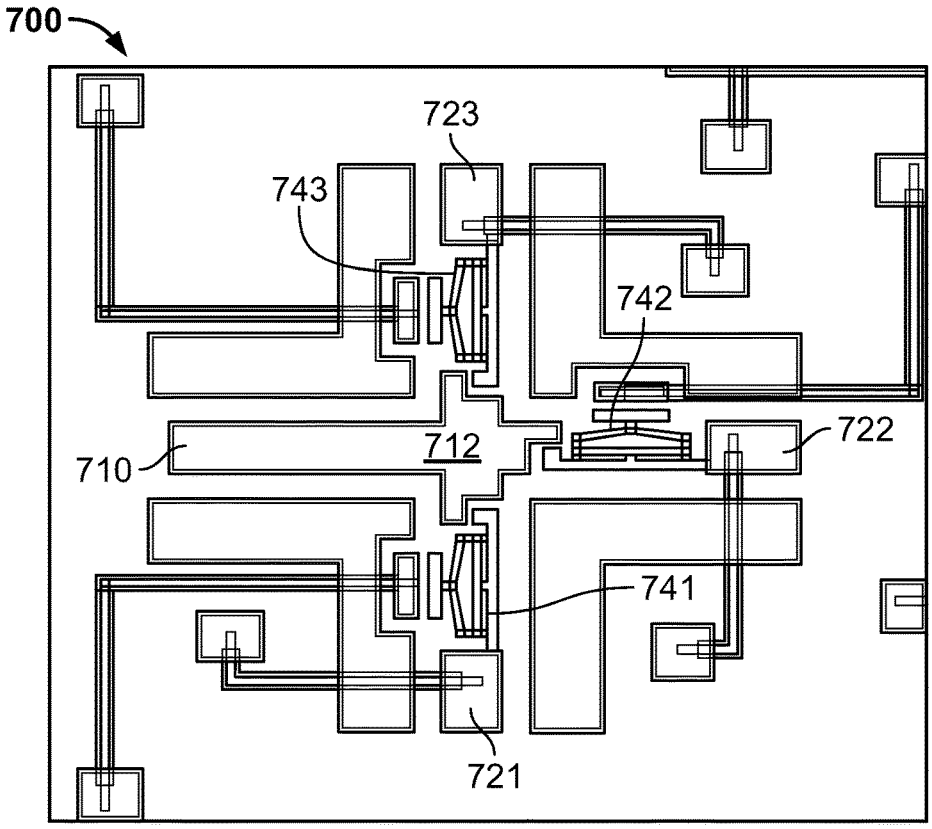
FIG. 7 is a plan view diagram of a single pole three throw (SP3T) lateral switch in accordance with aspects of the present disclosure.

FIG. 7 shows an example RF MEMS single pole three throw (SP3T) lateral switch 700 in accordance with an aspect of the present disclosure. The input port 710 of the lateral switch includes a central junction 712. The switch also includes three output ports 721, 722, 723 from which three separate cantilever beams 741, 742, 743 that extend to contact the central junction 712. Each cantilever beam includes a mechanical spring that is actuated by a separate actuator. Each actuator is also shown as being biased by a separate bias pad. Like in the example of FIG. 5, at a given time, one of the actuators may be biased, such that the cantilever beam associated with that actuator is deflected and contacts its corresponding output port. In the present example, the input port 710 and cantilever beams 741, 742, 743 are uniformly distributed around the central junction 712, although in other examples, the configuration may not be uniform.

Figure 8:
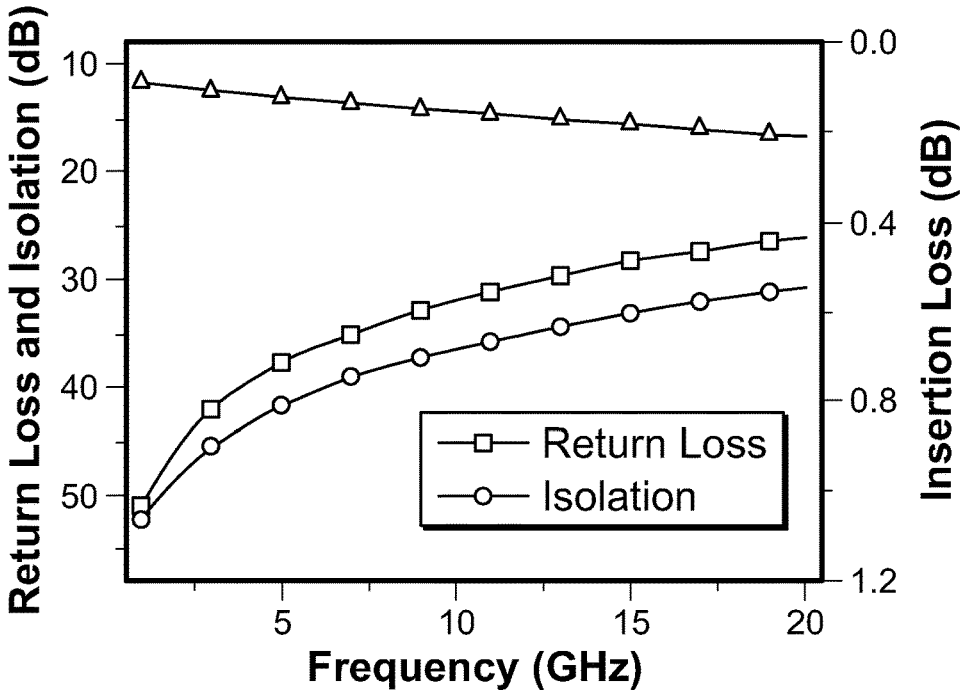
FIG. 8 is a graphical representation of return loss, isolation, and insertion loss for the lateral switch of FIG. 7.

FIG. 8 shows an average simulated return loss, isolation, and insertion loss for the output ports 721, 722, 723 of the example SP3T lateral switch design of FIG. 7. As shown in the figures, the SP3T switch exhibits, on average, return loss of better than about 26 dB, isolation of about 30 dB, and worst case insertion loss of about 0.22 dB at frequencies of up to about 20 GHz.

Figure 9:
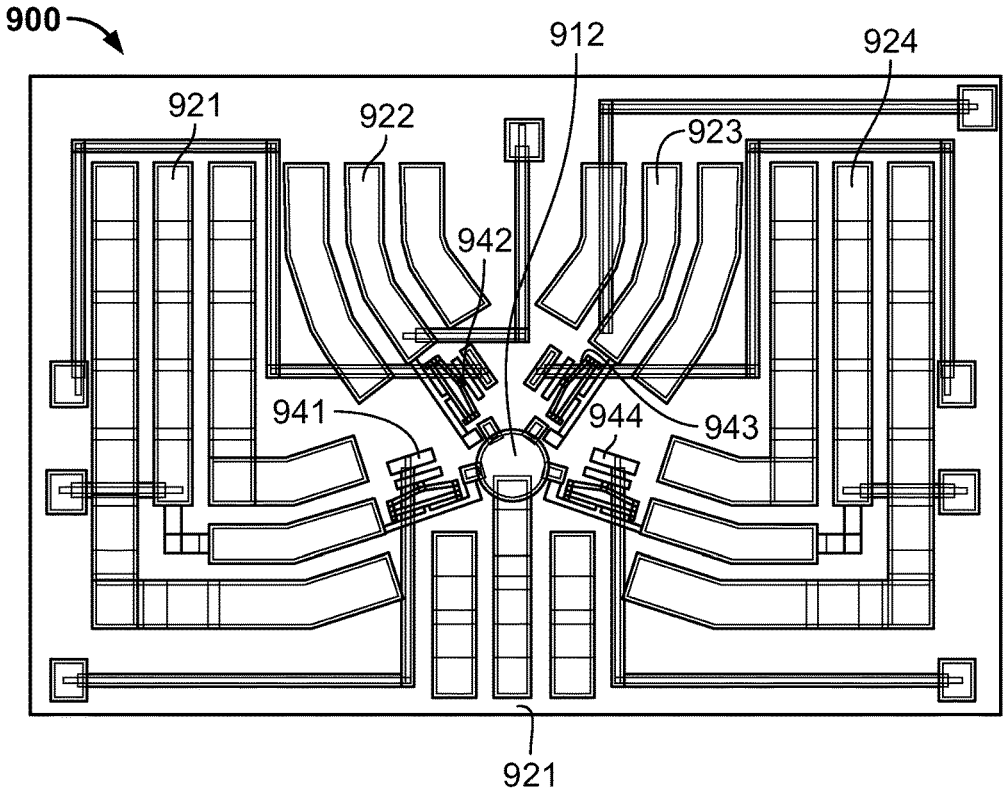
FIG. 9 is a plan view diagram of a single pole four throw (SP4T) lateral switch in accordance with aspects of the present disclosure.

FIG. 9 shows an example RF MEMS single pole four throw (SP4T) lateral switch 900 in accordance with an aspect of the present disclosure. The SP4T switch is similar in design to the SP3T switch in that each output port 921, 922, 923, 924 of the switch is connected to a separate cantilever beam 941, 942, 943, 944 that extends to contact a mechanical stopper on a central junction 912. The input port 910 and the cantilever beams 941, 942, 943, 944 are evenly distributed around the central junction 912. Each cantilever beam has its own mechanical spring, actuator and biasing pad to effect deflection of the beam.

Figure 10:
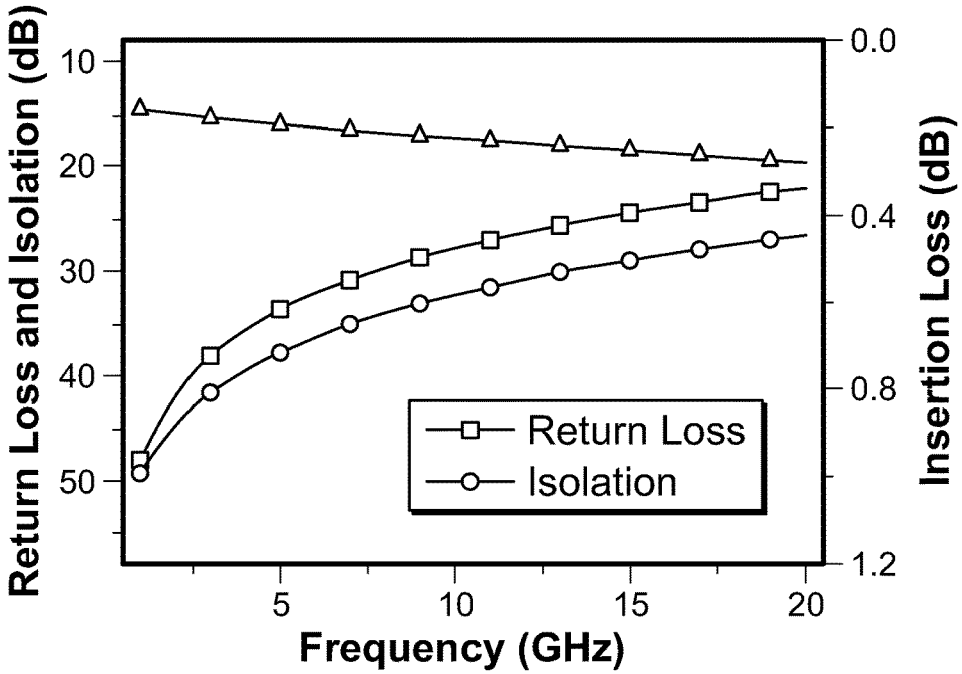
FIG. 10 is a graphical representation of return loss, isolation, and insertion loss for the lateral switch of FIG. 9.

FIG. 10 shows an average simulated return loss, isolation, and insertion loss for the four output ports of the example SP4T lateral switch design of FIG. 9. As shown in the figures, the SP4T switch exhibits return loss of better than about 20 dB, isolation of about 26 dB, and worst case insertion loss of about 0.26 dB at frequencies of up to about 20 GHz.

Figure 11:
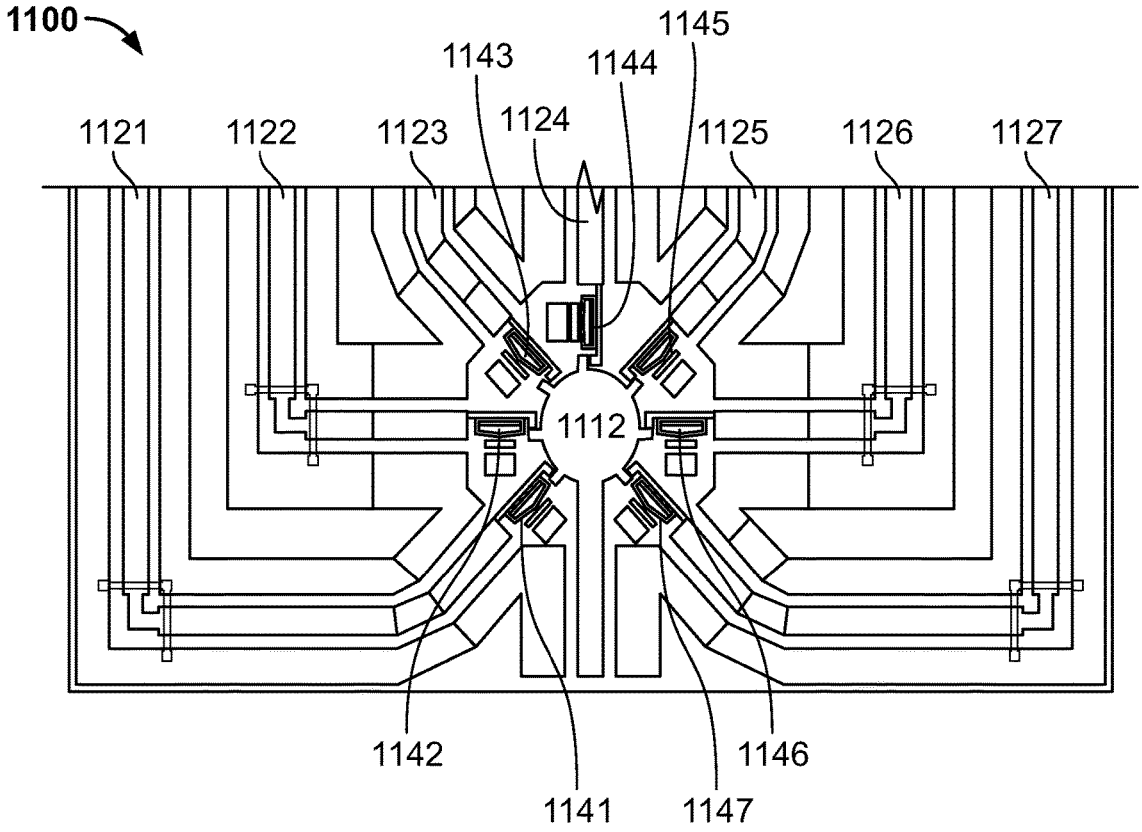
FIG. 11 is a plan view diagram of a single pole seven throw (SPIT) lateral switch in accordance with aspects of the present disclosure.

FIG. 11 shows an example RF MEMS single pole seven throw (SP7T) lateral switch 1100 in accordance with an aspect of the present disclosure. The SP7T switch 1100 is similar in design to the SP3T and SP4T switches in that each output port 1121-1127 of the switch is connected to a separate cantilever beam 1141-1147 that extends to contact a mechanical stopper on a central junction 1112. The input port 1110 and cantilever beams 1141-1147 are evenly distributed around the central junction 1112. Each cantilever beam has its own mechanical spring, actuator and biasing pad to effect deflection of the beam.

Figure 12:
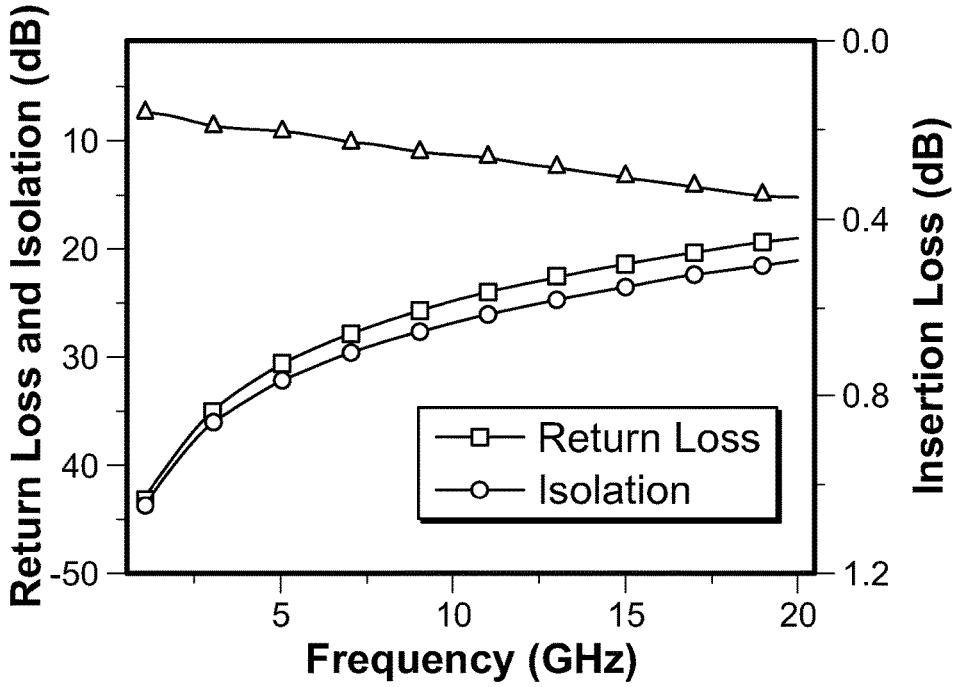
FIG. 12 is a graphical representation of return loss, isolation, and insertion loss for the lateral switch of FIG. 11.

FIG. 12 shows an average simulated return loss, isolation, and insertion loss for the seven ports of the example SP7T lateral switch design of FIG. 11. As shown in the figures, the SP7T switch exhibits return loss of better than about 19 dB, isolation of about 20 dB, and worst case insertion loss of about 0.36 dB at frequencies of up to about 20 GHz.

Figure 13:
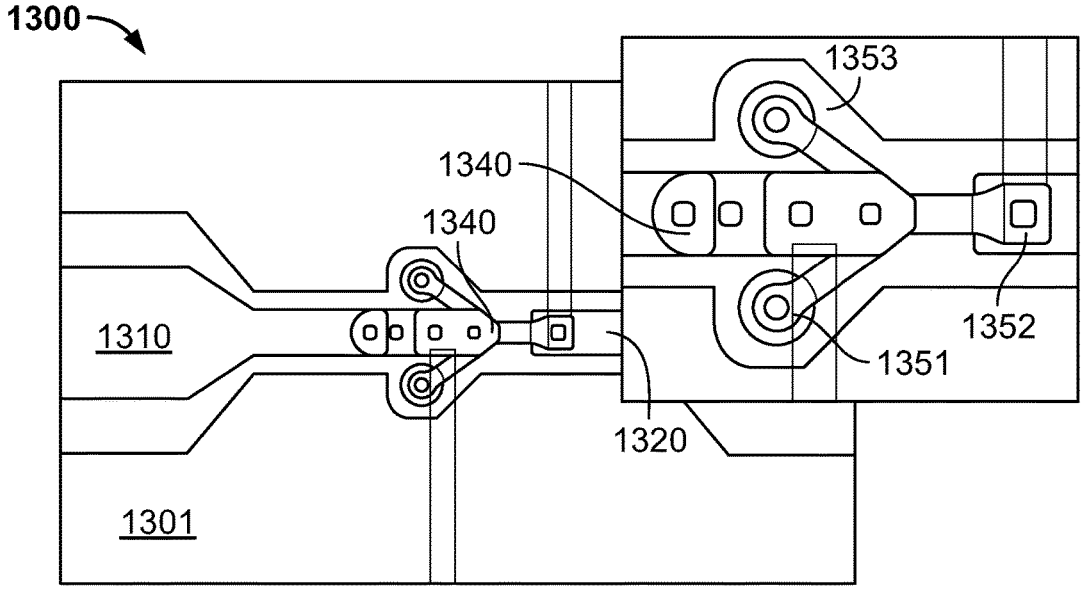
FIG. 13 is a plan view diagram of another example single pole single throw (SPST) MEMS switch in accordance with aspects of the present disclosure.

FIG. 13 shows another example RF MEMS switch 1300 in accordance with an aspect of the present disclosure. Unlike the lateral switch of FIG. 2A, the switch of FIG. 13 includes an out-of-plane cantilever beam 1340 connecting a first port 1310 to a second port 1320 in a coplanar waveguide 1301. The beam 1340 is attached to three mechanical springs 1351, 1352, 1353 arranged under the beam and relative to one another in a Y-configuration. Unlike the single mechanical spring of FIGS. 2A and 2B, which moves side to side (relative to a line drawn between the ports) and within the plane of the waveguide to actuate the lateral switch, the mechanical springs of FIG. 13 move up and down, orthogonal to the plane of the waveguide. When the springs raise the beam upward, the beam is disconnected from the second port 1320, thereby opening the switch. When the springs move the beam downward, the beam is connected to the second port, thereby closing the switch. Function of the mechanical springs may be compared to that described in connection with the lateral switch, except that the springs of FIG. 13 move in a different direction to accommodate the out-of-plane movement of the cantilever beam.

In the example of FIG. 13, the actuation voltage of the switch is between about 58 V and about 60 V, and the mechanical resonance frequency is about 51 kHz. The total area (including bias lines and pads) of the switch is about 0.094 $mm^2$, which enables the achievement of very compact switching networks without compromising microwave performance.

Benefits of the switch of FIG. 13 include: (1) A reduced sensitivity to stress due to its small size and fast switching time; (2) a reduced sensitivity to planarity and stress due to its being a single-contact cantilever switch (this may significantly improve the overall contact force and improve division of electrostatic force over the various paths surrounding the switch, such as in a phase shifter) (3) reduced risk of switch failure due to contact failure (e.g., a contact becoming permanently stuck down) or actuator failure (e.g., a contact becoming permanently stuck up); (4) reduced sensitivity to stress gradients (Residual stress often results in uneven distribution of tip deflection between even identical structures. Hence, different blocks often need different voltages to actuate. The reduction in stress allows for the same voltage to be needed for actuation, thereby decreasing overall yield of the device in which multiple switches are actuated); and (5) improved compactness of multi-switch structures, since the switch may be easily placed on a CPW line. Additional benefits include low cost (batch production) low insertion loss, good input/output matching and moderate isolation response for designs with up to fourteen channels operating at a frequency of up to 12 GHz.

Figure 14:
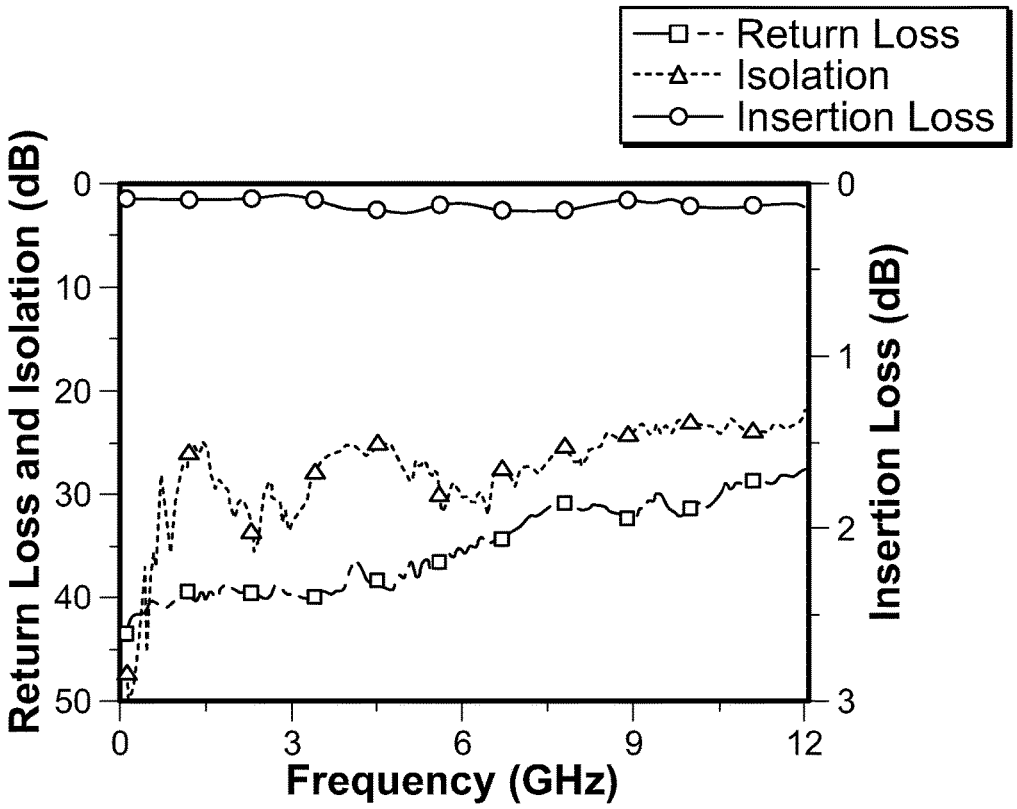
FIG. 14 is a graphical representation of return loss, isolation, and insertion loss for the lateral switch of FIG. 13.

FIG. 14 shows simulated return loss, isolation, and insertion loss for the example SPST switch design of FIG. 13. As shown in FIG. 14, the SPST switch exhibits return loss of better than about 30 dB, isolation of about 21 dB, and worst case insertion loss of about 0.2 dB at frequencies of up to about 12 GHz.

Figure 15:
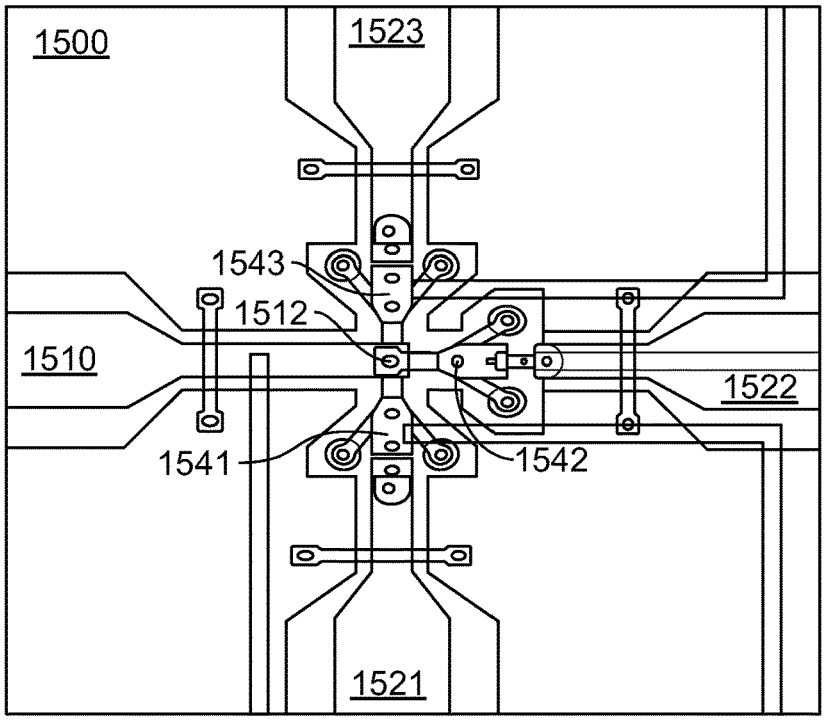
FIG. 15 is a plan view diagram of another example single pole three throw (SP3T) MEMS switch in accordance with aspects of the present disclosure.

FIG. 15 shows an example RF MEMS SP3T switch 1500. Like the SPST switch of FIG. 13, the SP3T switch of FIG. 15 uses an out-of-plane configuration for the cantilever beams and springs. The switch includes an input port 1510 extending to a center of the switch to provide a central junction 1512, and three output ports 1521, 1522, 1523. The switch also includes three cantilever beams 1541, 1542, 1543 each extending from a respective output port and switchably connectable to the central junction by an out-of-plane movement. Also like in FIG. 13, each beam includes three springs arranged in a Y-configuration. The input port and beams are evenly distributed around the central junction 1512. The total area of the SP3T switch is about 0.43 $mm^2$.

Figure 16:
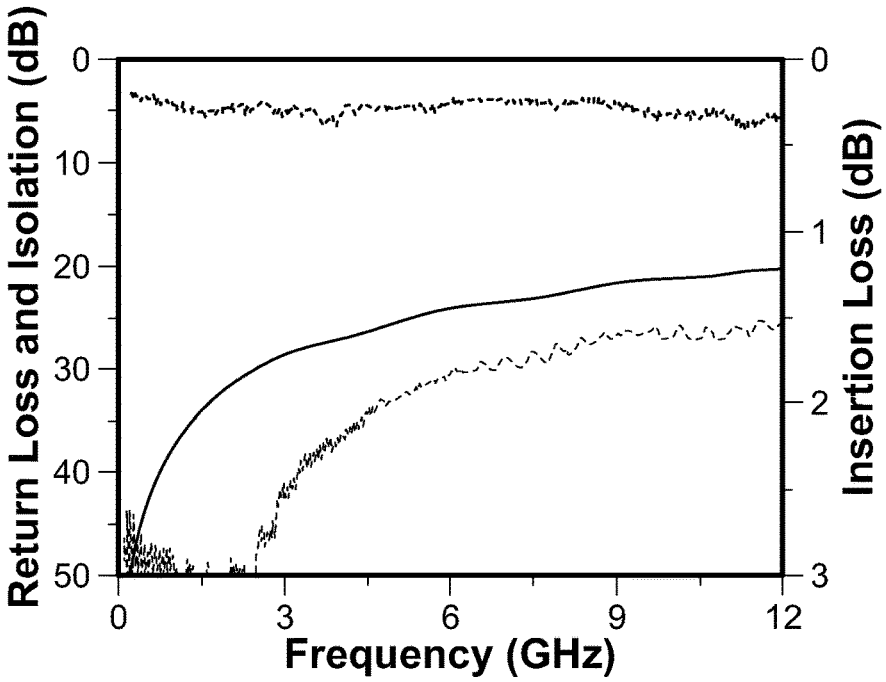
FIG. 16 is a graphical representation of return loss, isolation, and insertion loss for the lateral switch of FIG. 15.

FIG. 16 shows simulated return loss, isolation, and insertion loss for the example SP3T switch design of FIG. 15. As shown in FIG. 16, the SP3T switch exhibits return loss of better than about 25 dB, isolation of about 22 dB, and worst case insertion loss of about 0.35 dB at frequencies of up to about 12 GHz.

Figure 17:
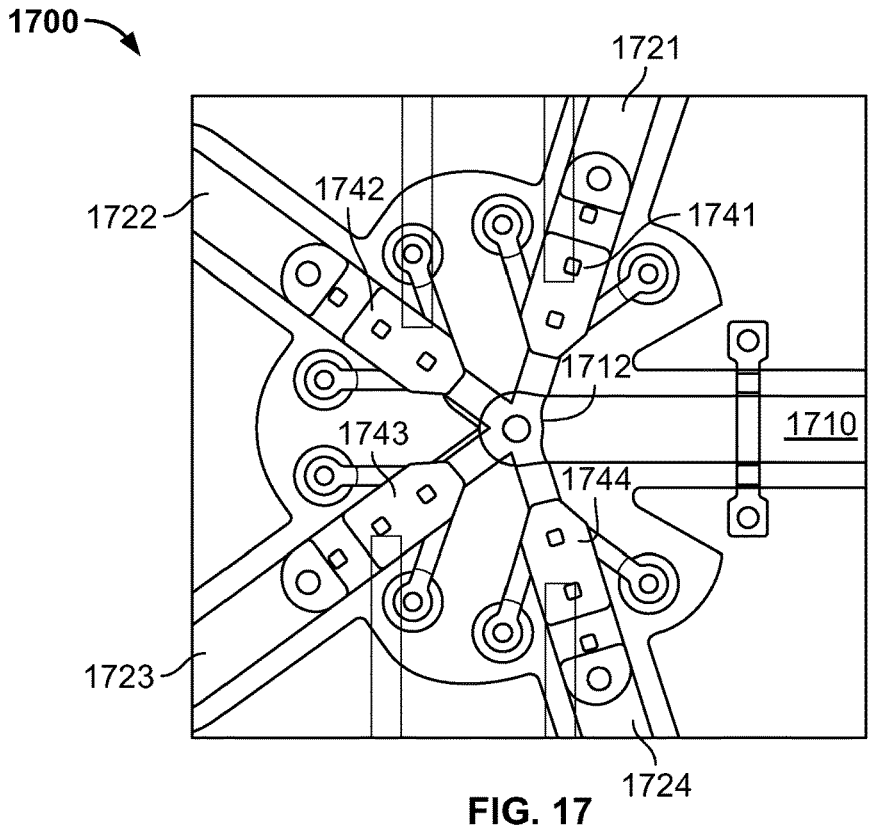
FIG. 17 is a plan view diagram of another example single pole four throw (SP4T) MEMS switch in accordance with aspects of the present disclosure.

FIG. 17 shows an example RF MEMS SP4T switch 1700 in accordance with an aspect of the present disclosure. The SP4T switch 1700 includes an input port 1710 extending to a center of the switch to provide a central junction 1712, and four output ports 1721, 1722, 1723, 1724. The switch also includes four cantilever beams 1741, 1742, 1743, 1744 each extending from a respective output port and switchably connectable to the central junction by an out-of-plane movement. Each beam includes three springs arranged in a Y-configuration. The input port and beams are evenly distributed around the central junction. The total area of the SP4T switch is about 0.51 $mm^2$.

Figure 18:
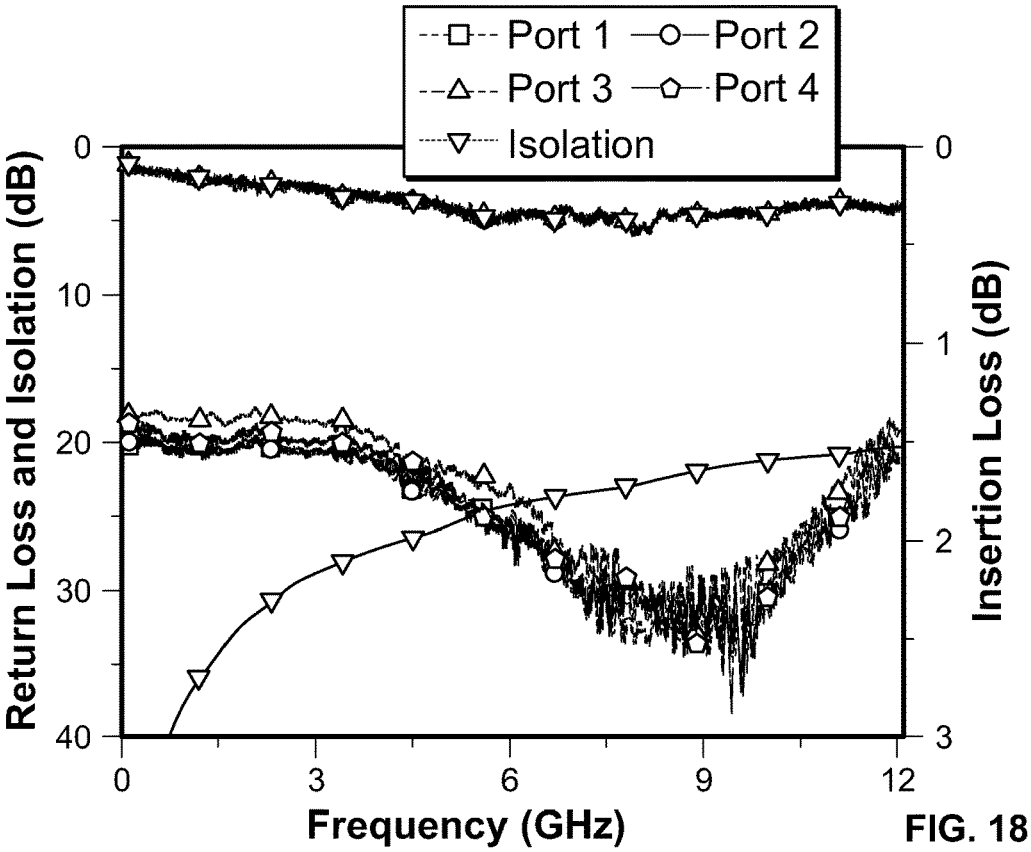
FIG. 18 is a graphical representation of return loss, isolation, and insertion loss for the lateral switch of FIG. 17.

FIG. 18 shows simulated return loss, isolation, and insertion loss for the example SP4T switch design of FIG. 17. As shown in FIG. 16, the SP4T switch exhibits return loss of better than about 18 dB, isolation of about 20 dB, and worst case insertion loss of about 0.43 dB at frequencies of up to about 12 GHz.

Figure 19:
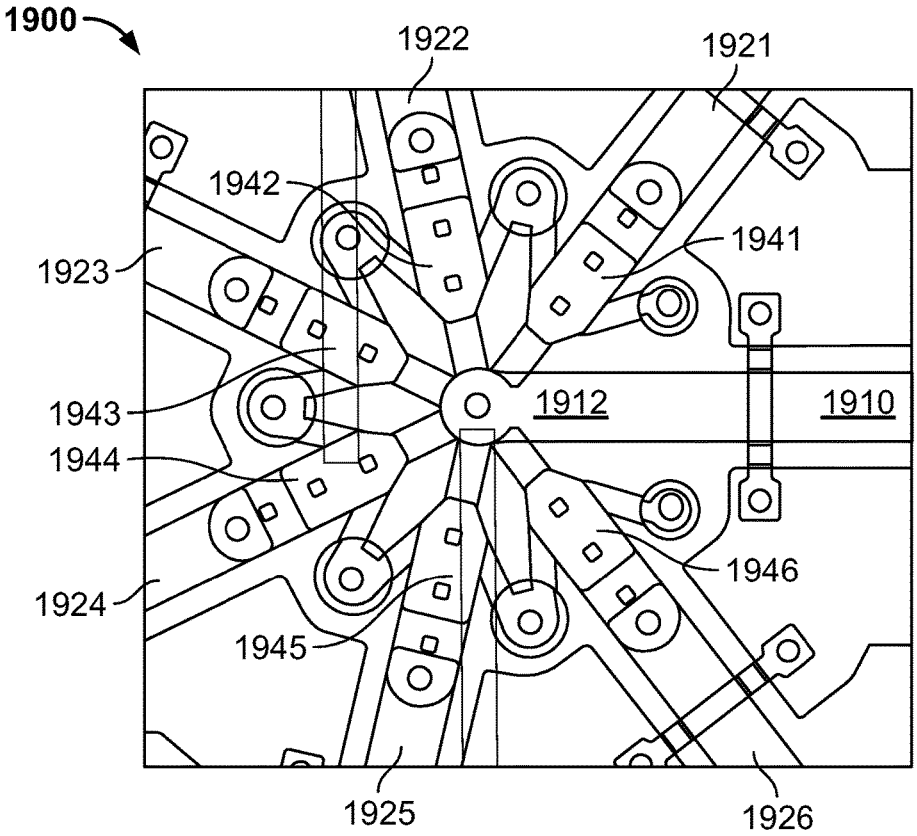
FIG. 19 is a plan view diagram of another example single pole six throw (SP6T) MEMS switch in accordance with aspects of the present disclosure.

FIG. 19 shows an example RF MEMS single-pole six-throw (SP6T) switch 1900 in accordance with an aspect of the present disclosure. The SP6T switch 1900 includes an input port 1910 extending to a center of the switch to provide a central junction 1912, and six output ports 1921-1926. The switch also includes four cantilever beams 1941-1946 each extending from a respective output port and switchably connectable to the central junction by an out-of-plane movement. Each beam includes three springs arranged in a Y-configuration. The input port and beams are evenly distributed around the central junction. The total area of the SP6T switch is about 0.58 $mm^2$.

Figure 20:
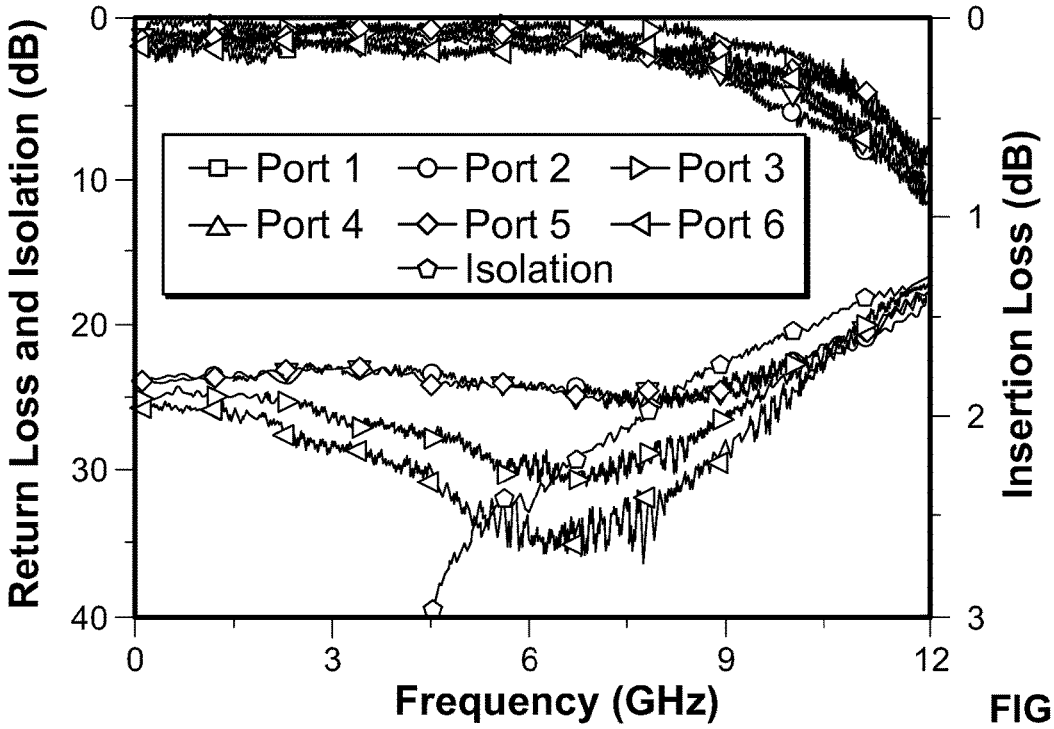
FIG. 20 is a graphical representation of return loss, isolation, and insertion loss for the lateral switch of FIG. 19.

FIG. 20 shows simulated return loss, isolation, and insertion loss for the example SP6T switch design of FIG. 19. As shown in FIG. 20, the SP6T switch exhibits return loss of better than about 18 dB, isolation of about 17.5 dB, and worst case insertion loss of about 0.78 dB at frequencies of up to about 12 GHz.

Figure 21:
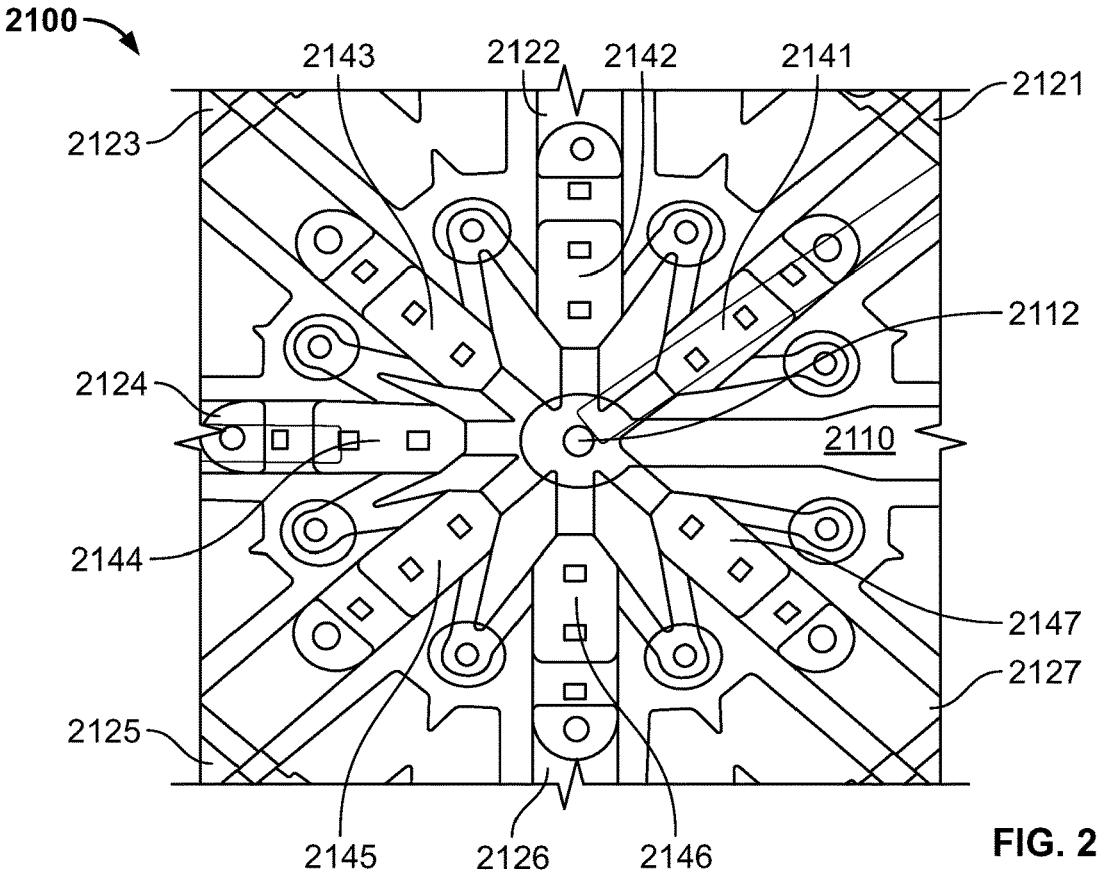
FIG. 21 is a plan view diagram of another example single pole seven throw (SPIT) MEMS switch in accordance with aspects of the present disclosure.

FIG. 21 shows an example RF MEMS single-pole seven-throw (SP7T) switch 2100 in accordance with an aspect of the present disclosure. The SP7T switch 2100 includes an input port 2110 extending to a center of the switch to provide a central junction 2112, and seven output ports 2121-2127. The switch also includes seven cantilever beams 2141-2147 each extending from a respective output port and switchably connectable to the central junction by an out-of-plane movement. Each beam includes three springs arranged in a Y-configuration. The input port and beams are evenly distributed around the central junction. The total area of the SP7T switch is about 0.64 $mm^2$.

Figure 22:
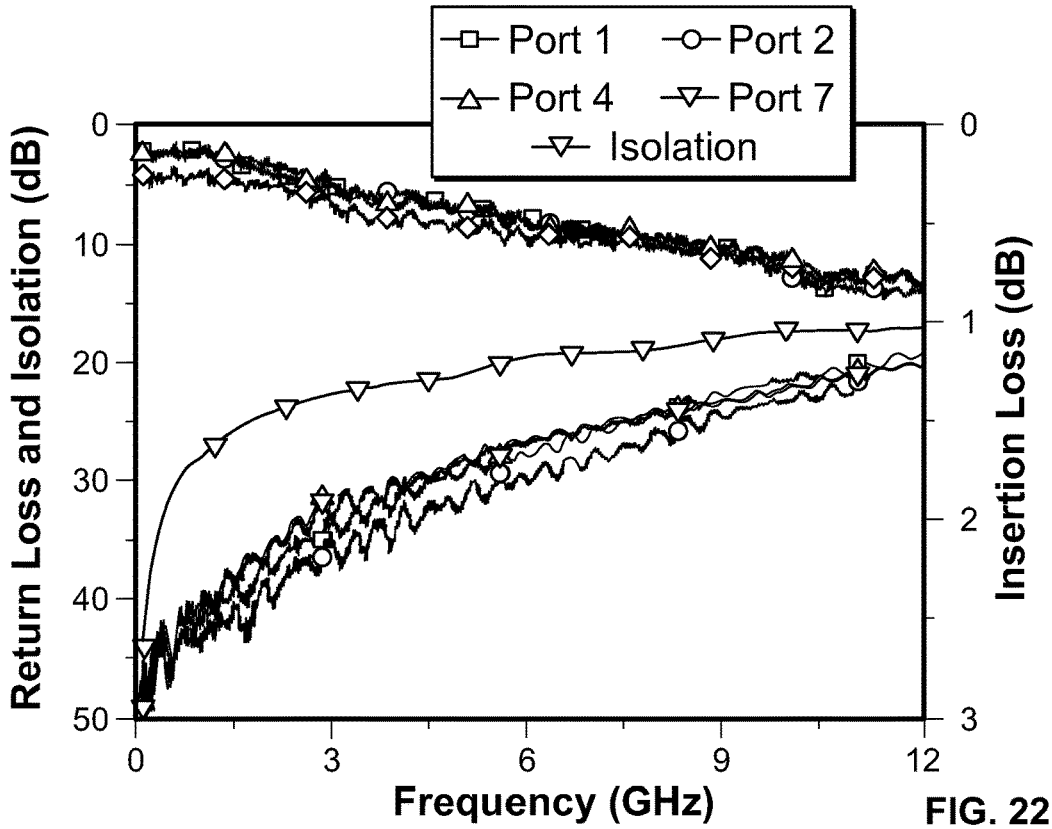
FIG. 22 is a graphical representation of return loss, isolation, and insertion loss for the lateral switch of FIG. 21.

FIG. 22 shows simulated return loss, isolation, and insertion loss for the example SP7T switch design of FIG. 21. As shown in FIG. 22, the SP7T switch exhibits return loss of better than about 19 dB, isolation of about 17.6 dB, and worst case insertion loss of about 0.88 dB at frequencies of up to about 12 GHz.

Figure 23:
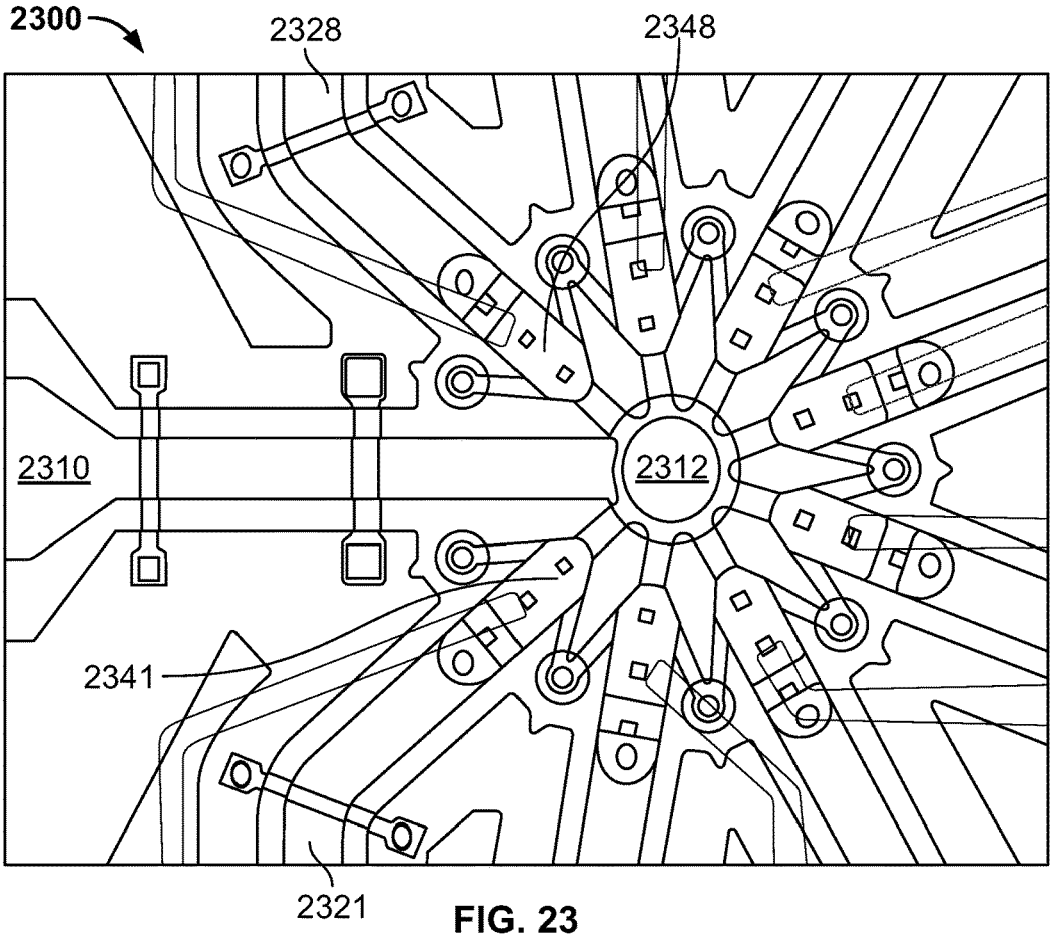
FIG. 23 is a plan view diagram of another example single pole eight throw (SP8T) MEMS switch in accordance with aspects of the present disclosure.

FIG. 23 shows an example RF MEMS single-pole eight-throw (SP8T) switch 2300 in accordance with an aspect of the present disclosure. The SP8T switch 2300 includes an input port 2310 extending to a center of the switch to provide a central junction 2312, and seven output ports 2321-2328. The switch also includes seven cantilever beams 2341-2348 each extending from a respective output port and switchably connectable to the central junction by an out-of-plane movement. Each beam includes three springs arranged in a Y-configuration. The input port and beams are evenly distributed around the central junction. The total area of the SP8T switch is about 0.68 $mm^2$.

Figure 24:
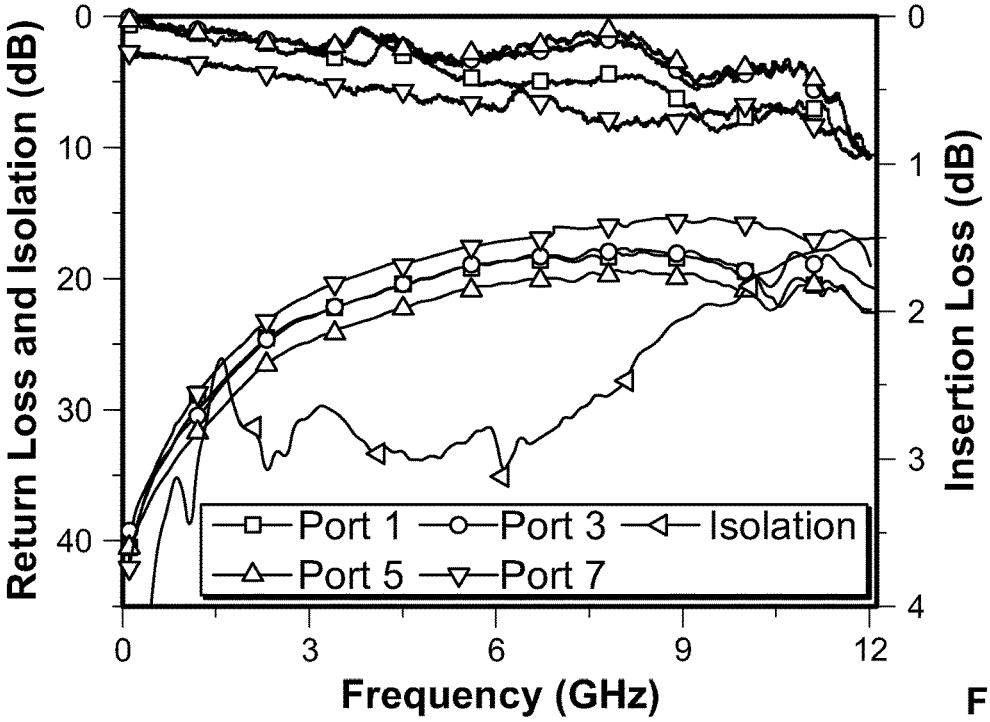
FIG. 24 is a graphical representation of return loss, isolation, and insertion loss for the lateral switch of FIG. 23.

FIG. 24 shows simulated return loss, isolation, and insertion loss for the example SP8T switch design of FIG. 23. As shown in FIG. 24, the SP8T switch exhibits return loss of better than about 15 dB, isolation of about 17 dB, and worst case insertion loss of about 1 dB at frequencies of up to about 12 GHz.

Figure 25:
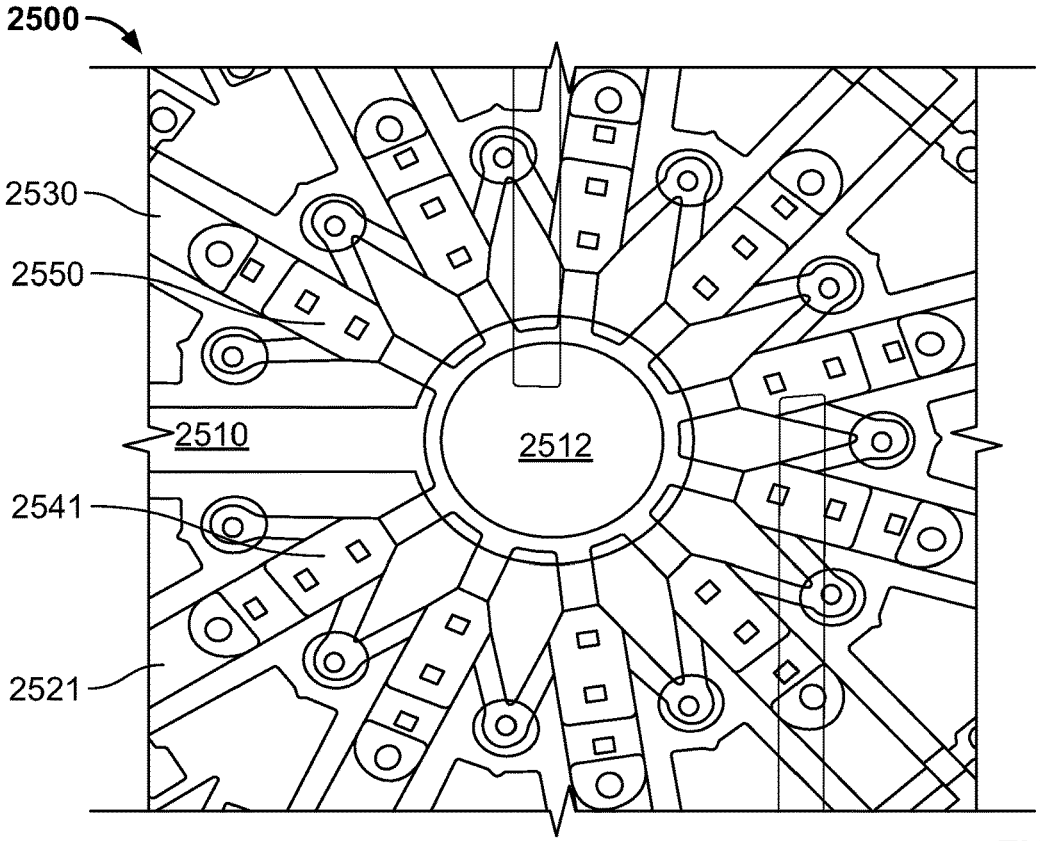
FIG. 25 is a plan view diagram of another example single pole ten throw (SP10T) MEMS switch in accordance with aspects of the present disclosure.

FIG. 25 shows an example RF MEMS single-pole ten-throw (SP10T) switch 2500 in accordance with an aspect of the present disclosure. The SP10T switch 2500 includes an input port 2510 extending to a center of the switch to provide a central junction 2512, and seven output ports 2521-2530. The switch also includes seven cantilever beams 2541-2550 each extending from a respective output port and switchably connectable to the central junction by an out-of-plane movement. Each beam includes three springs arranged in a Y-configuration. The input port and beams are evenly distributed around the central junction. The total area of the SP10T switch is about 0.83 $mm^2$.

Figure 26:
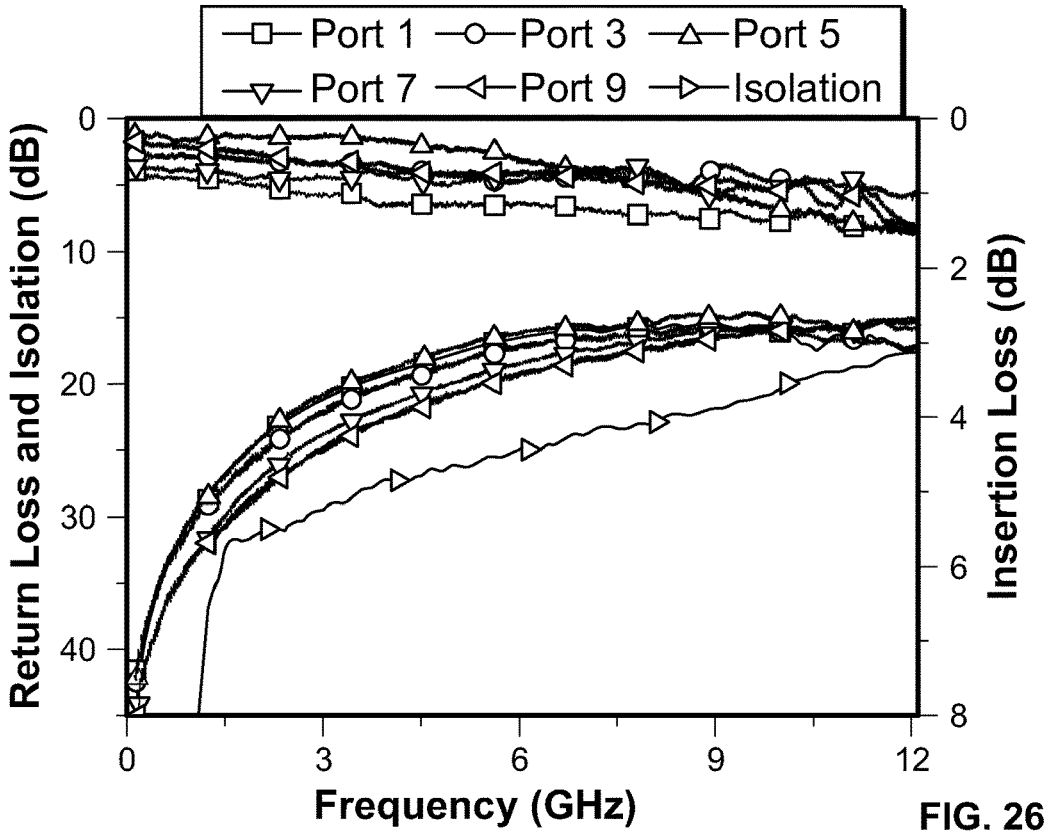
FIG. 26 is a graphical representation of return loss, isolation, and insertion loss for the lateral switch of FIG. 25.

FIG. 26 shows simulated return loss, isolation, and insertion loss for the example SP10T switch design of FIG. 25. As shown in FIG. 26, the SP10T switch exhibits return loss of better than about 14.7 dB, isolation of about 17 dB, and worst case insertion loss of about 1.5 dB at frequencies of up to about 12 GHz.

Figure 27:
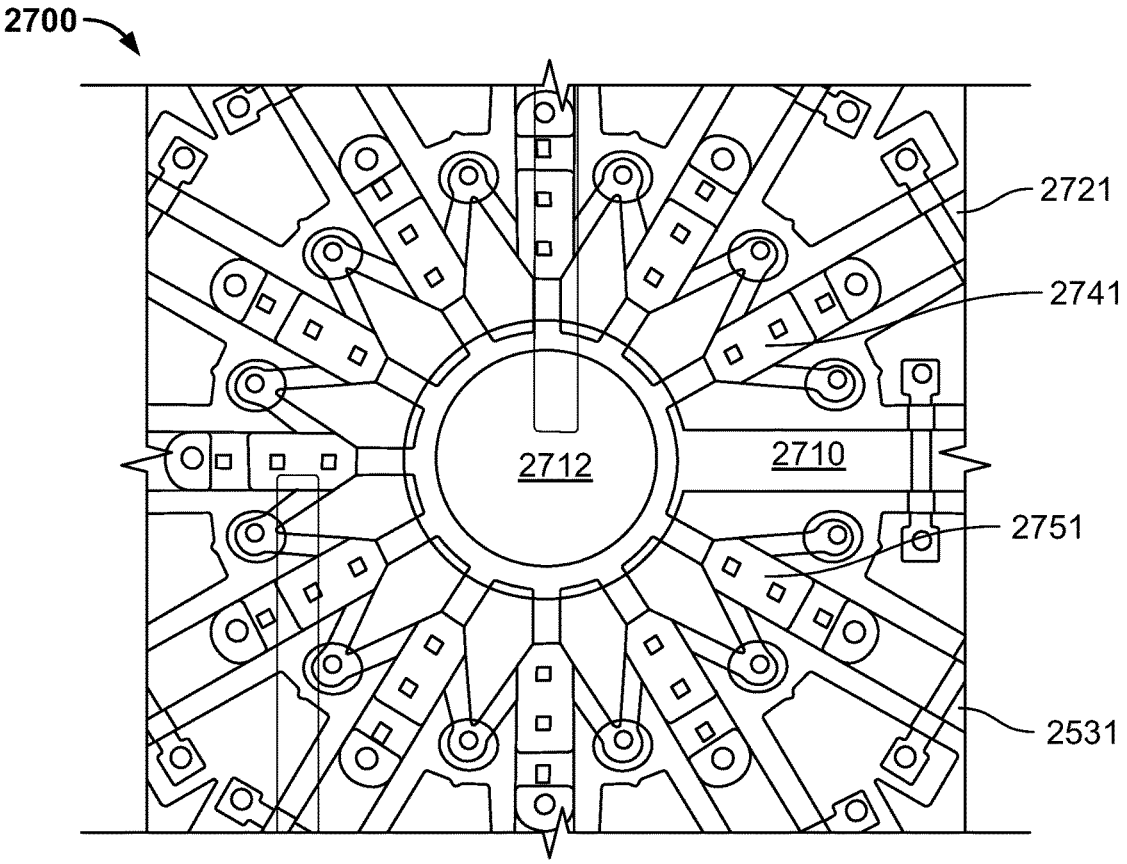
FIG. 27 is a plan view diagram of another example single pole eleven throw (SP11T) MEMS switch in accordance with aspects of the present disclosure.

FIG. 27 shows an example RF MEMS single-pole eleven-throw (SP11T) switch 2700 in accordance with an aspect of the present disclosure. The SP11T switch 2700 includes an input port 2110 extending to a center of the switch to provide a central junction 2712, and seven output ports 2721-2731. The switch also includes seven cantilever beams 2741-2751 each extending from a respective output port and switchably connectable to the central junction by an out-of-plane movement. Each beam includes three springs arranged in a Y-configuration. The input port and beams are evenly distributed around the central junction. The total area of the SP11T switch is about 0.92 $mm^2$.

Figure 28:
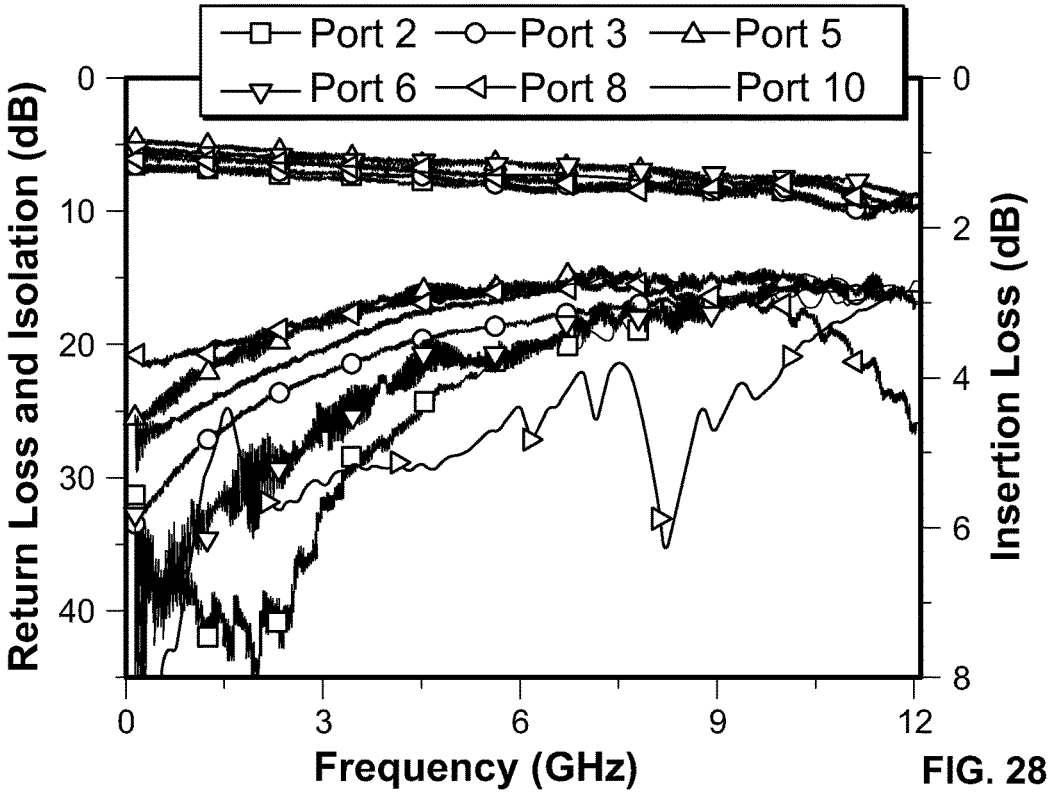
FIG. 28 is a graphical representation of return loss, isolation, and insertion loss for the lateral switch of FIG. 27.

FIG. 28 shows simulated return loss, isolation, and insertion loss for the example SP11T switch design of FIG. 27. As shown in FIG. 28, the SP11T switch exhibits return loss of better than about 15 dB, isolation of about 17 dB, and worst case insertion loss of about 1.8 dB at frequencies of up to about 12 GHz.

Figure 29:
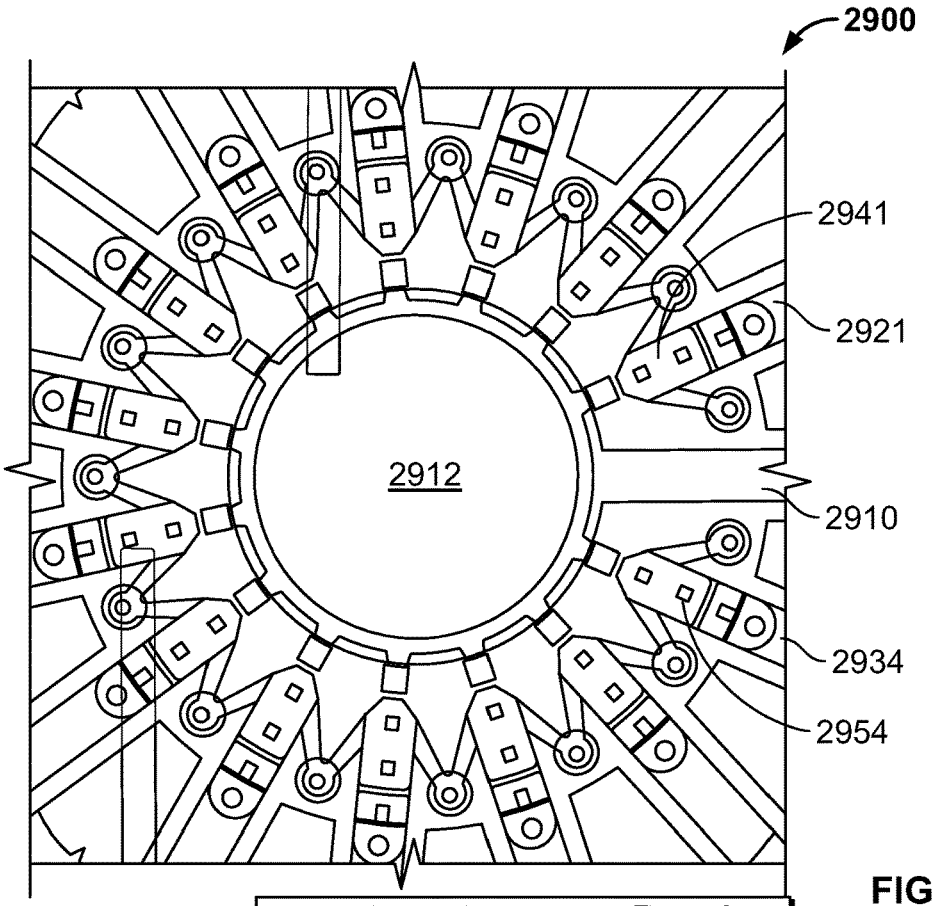
FIG. 29 is a plan view diagram of another example single pole fourteen throw (SP14T) MEMS switch in accordance with aspects of the present disclosure.

FIG. 29 shows an example RF MEMS single-pole fourteen-throw (SP14T) switch 2900 in accordance with an aspect of the present disclosure. The SP14T switch 2900 includes an input port 2910 extending to a center of the switch to provide a central junction 2912, and seven output ports 2921-2934. The switch also includes seven cantilever beams 2941-2954 each extending from a respective output port and switchably connectable to the central junction by an out-of-plane movement. Each beam includes three springs arranged in a Y-configuration. The input port and beams are evenly distributed around the central junction. The total area of the SP14T switch is about 1.2 $mm^2$.

Figure 30:
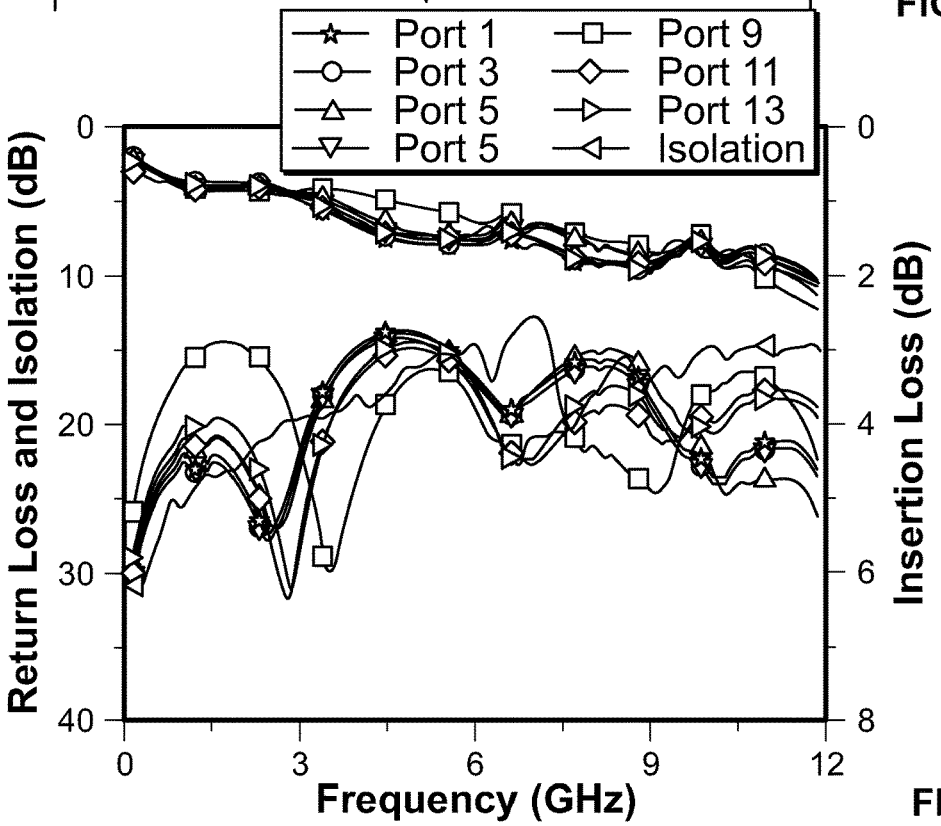
FIG. 30 is a graphical representation of return loss, isolation, and insertion loss for the lateral switch of FIG. 29.

FIG. 30 shows simulated return loss, isolation, and insertion loss for the example SP14T switch design of FIG. 29. As shown in FIG. 30, the SP14T switch exhibits return loss of better than about 14 dB, isolation of about 14 dB, and worst case insertion loss of about 2.2 dB at frequencies of up to about 12 GHz.

Figure 31:
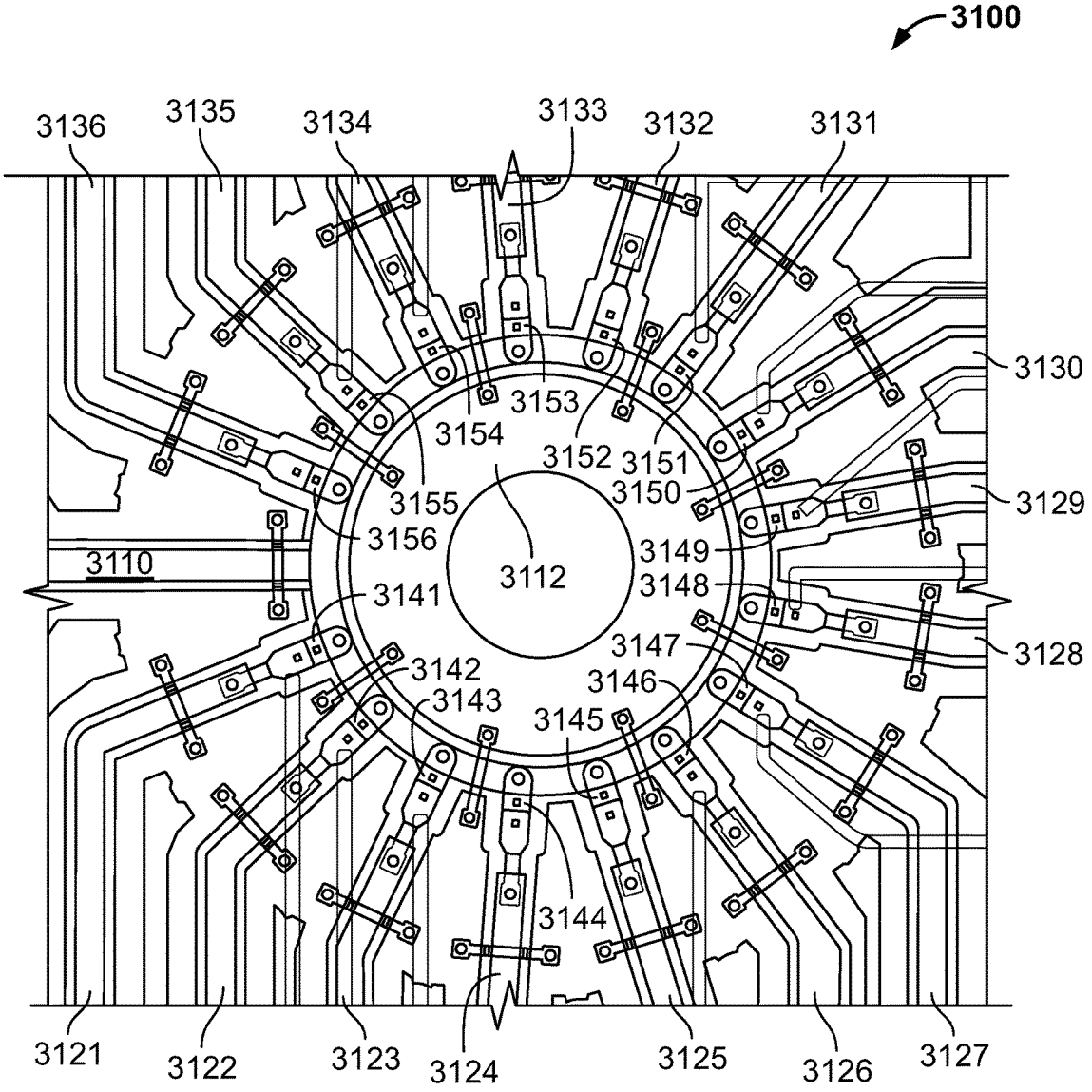
FIG. 31 is a plan view diagram of another example single pole sixteen throw (SP16T) MEMS switch in accordance with aspects of the present disclosure.

FIG. 31 shows an example RF MEMS single-pole sixteen-throw (SP16T) switch 3100 in accordance with an aspect of the present disclosure. The SP16T switch 3100 includes an input port 3110 extending to a center of the switch to provide a central junction 3112, and seven output ports 3121-3156. The switch also includes seven cantilever beams 3141-3156 each extending from a respective output port and switchably connectable to the central junction by an out-of-plane movement. Each beam includes three springs arranged in a Y-configuration. The input port and beams are evenly distributed around the central junction. The total area of the SP16T switch is about 2.5 $mm^2$ (about 1.56 mm across, and about 1.61 mm top to bottom as shown in FIG. 31)

Figure 32:
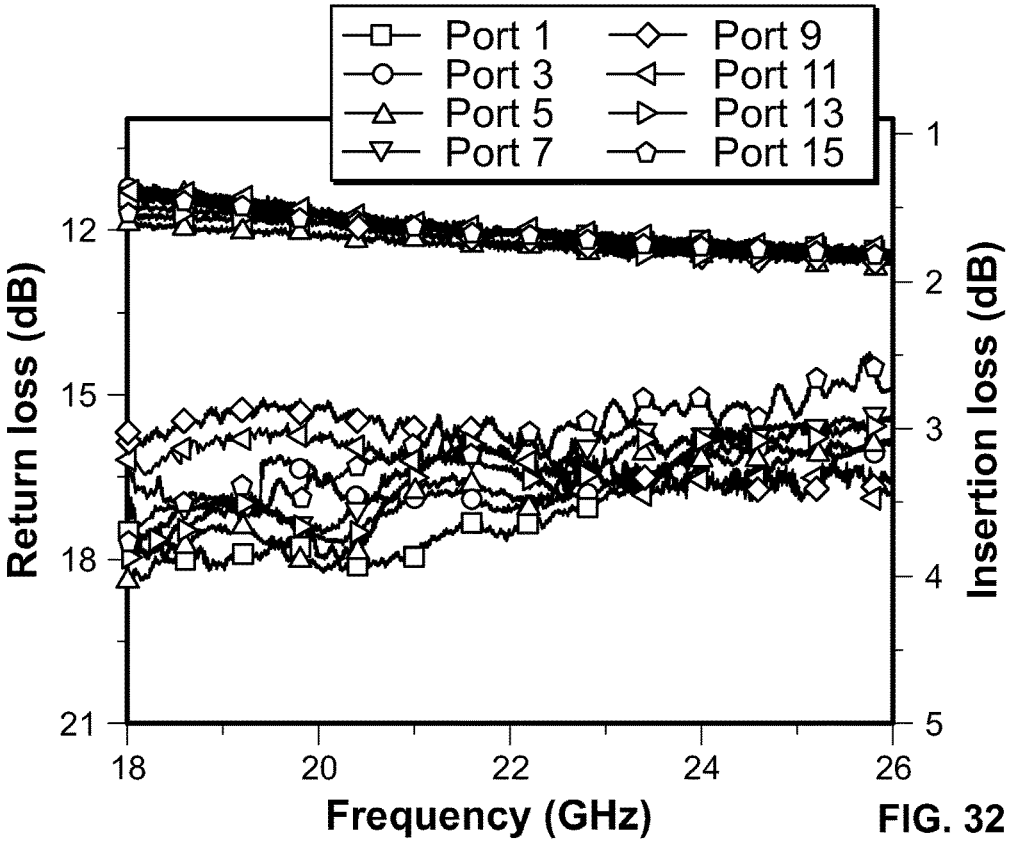
FIGS. 32-33 are graphical representations of return loss, isolation, and insertion loss for the lateral switch of FIG. 31.
Figure 33:
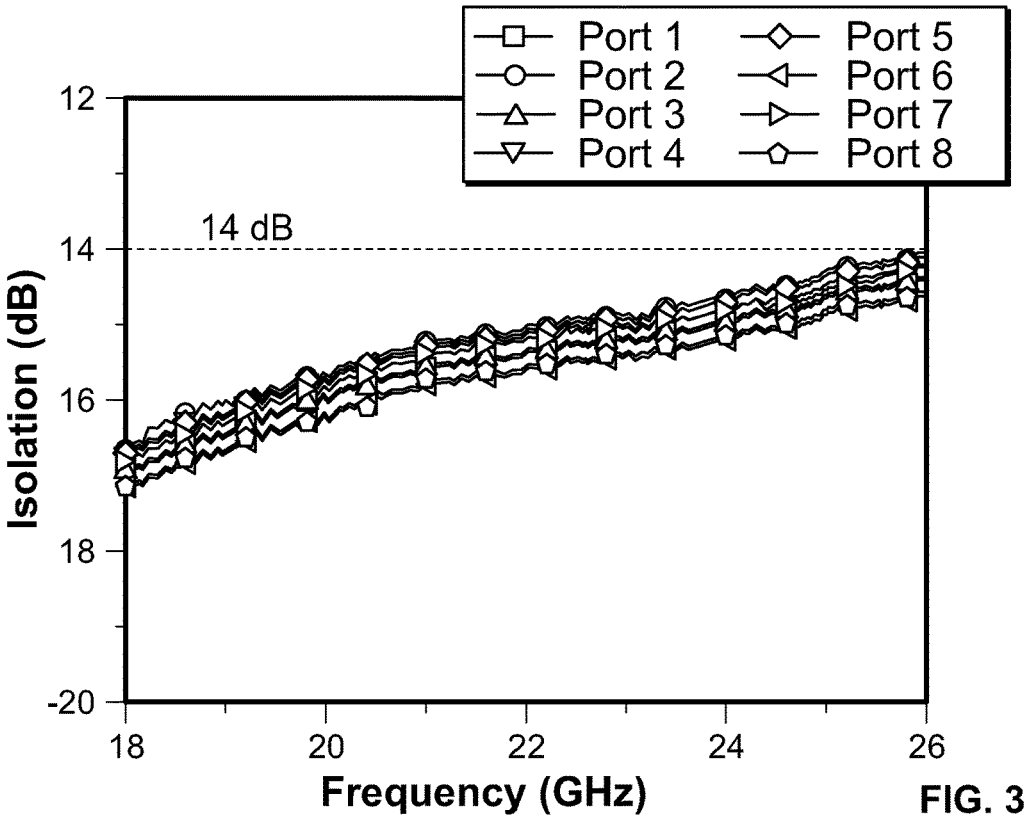

FIGS. 32 and 33 show simulated return loss, isolation, and insertion loss for the example SP16T switch design of FIG. 31. As shown in FIG. 32, the SP16T switch exhibits return loss of better than about 14 dB and worst case insertion loss of about 1.9 dB at frequencies of up to about 26 GHz. FIG. 33 shows isolation of about 14 dB up to similar frequencies.

As compared to the lateral switches of FIGS. 2-12, the configurations shown and demonstrated in FIGS. 13-33 permit the switches to be placed lateral to one another even closer together without introducing difficulties to the fabrication process. Ultimately, this leads to a reduction of overall area of a device incorporating these switches. As shown, the reduction of area may be on the order of square microns or even a few square millimeters.

Matching and loss of a switching network including the above example switches, and particularly the above example SPMT switches, may be improved by reducing the parasitic inductive effects caused by the switches. These effects largely occur between the central junctions of adjacent switches. Parameters such as central junction length (as well as switch footprint, parasitic inductive effects) may be tested using a full wave simulation. The results of the full wave simulation may then be utilized to modify the switch parameters, thereby improving or optimizing performance.

The above example switches feature additional design considerations and constraints. For instance, the CPW discontinuities (e.g., between adjacent switches) may include inductive bends. The purpose of these bends is to eliminate higher order modes. The bias pads of the switches may also be routed in a manner that avoids signal leakage and other parasitic effects without affecting performance. The bias pads and lines may themselves be made of a conductive material (e.g., titanium tungsten), and a film or layer of dielectric material (e.g., silicon dioxide) may be positioned between the bias lines and CPW to prevent shorting.

Another beneficial property of the configuration of above example switches is their symmetry (e.g., equal angle between each throw of a given switch, equal angle between the each of the input/output ports). Additionally, each of the switches (with the exception of the SP3T switch of FIG. 7) has a mirror symmetry along an axis extending from the input port to the central junction. This configuration of the above example switches permits them to be placed closer together with one another (in designs that accommodate multiple switches). This means that a device with multiple MEMS RF lateral switches (e.g., a phase shifter) may be designed with greater compactness without any fabrication difficulties. The symmetry is especially beneficial for improving compactness of the design. Ultimately, the presently described switch configuration may lead to reduction of overall area of a device including these switches on the order of square microns or even square millimeters, as compared to other conventional topologies.

Each of the above described RF MEMS lateral switches exhibits a wideband response with reduced loss, increased isolation and reduced size (improved compactness). Moreover, the RF MEMS switches are capable of being operated at frequencies of up to about 20 GHz with a large number of ports. Therefore, these switches are useful for such applications as satellite switching networks wideband radios, and the like.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The invention claimed is:

1. A microelectromechanical switch comprising:

a first port;

one or more second ports;

a cantilever beam, having a first end in contact with either the first port or one of the second ports, and extending from the first end toward a second end that is switchably connectable to the other of said first port and said one of the second ports; and a mechanical spring, connected to the cantilever beam, for providing a mechanical force to move the cantilever beam, wherein the mechanical spring is a compression spring.

2. The microelectromechanical switch according to claim 1, wherein the switch is a lateral switch, and the mechanical spring provides a mechanical force to move the cantilever beam in a lateral direction.

3. The microelectromechanical switch according to claim 1, wherein the mechanical spring is configured in a semi-triangular shape.

4. The microelectromechanical switch according to claim 1, wherein the mechanical spring provides a mechanical force to move the cantilever beam in an out-of plane direction.

5. The microelectromechanical switch according to claim 1, comprising at least three mechanical springs, each mechanical spring connected to the cantilever beam for providing a mechanical force to move the cantilever beam.

6. The microelectromechanical switch according to claim 1, wherein the three mechanical springs are arranged in a Y-configuration.

7. The microelectromechanical switch according to claim 1, wherein the mechanical spring is actuated by an electrostatic force.

8. The microelectromechanical switch according to claim 1, wherein the first and second ports and cantilever beam are formed in a coplanar waveguide.

9. The microelectromechanical switch according to claim 1, further comprising an actuator applying a bias voltage, wherein deflection of the cantilever beam is at least in part determined by the applied bias voltage.

10. The microelectromechanical switch according to claim 9, wherein the first and second ports and cantilever beam are formed in a coplanar waveguide, and wherein the actuator is connected to a bias line, and wherein the bias line is formed from titanium tungsten and separated from the coplanar waveguide by a layer of silicon dioxide.

11. The microelectromechanical switch according to claim 1, wherein either said first port or said at least one second port includes a mechanical stopper for contacting the second end of the cantilever beam, and wherein, when the microelectromechanical switch is open, the second end and the mechanical stopper are at a distance from one another that is greater than a distance between the mechanical spring and ground of a coplanar waveguide in which the first and second ports and the cantilever beam are formed.

12. The microelectromechanical switch according to claim 1, wherein the switch exhibits return loss of at least about 22 dB, isolation of at least about 30 dB, and insertion loss of at most about 0.2 dB at one or more frequencies up to about 20 GHz.

13. The microelectromechanical switch according to claim 1, wherein the total area of the switch is about 0.09 $mm^2$.

14. The microelectromechanical switch according to claim 1, comprising at least two second ports, wherein the first end of the cantilever beam is in contact with the first port, and the second end of the cantilever beam is switchably connectable to each of said two second ports, and wherein the cantilever beam is connected to at least two compression springs, each compression spring providing a mechanical force to move the cantilever beam towards or away from a respective one of said two second ports.

15. The microelectromechanical switch according to claim 14, wherein the switch exhibits return loss of at least about 25 dB, isolation of at least about 30 dB, and insertion loss of at most about 0.2 dB at one or more frequencies up to about 20 GHz.

16. The microelectromechanical switch according to claim 1, comprising at least three second ports and at least three cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction of the first port.

17. The microelectromechanical switch according to claim 16, wherein the switch exhibits one of:

return loss of at least about 26 dB, isolation of at least about 30 dB, and insertion loss of at most about 0.22 dB at one or more frequencies up to about 20 GHz for a lateral switch configuration; and return loss of at least about 25 dB, isolation of at least about 22 dB, and insertion loss of at most about 0.35 dB at one or more frequencies up to about 12 GHz for an out-of-plane switch configuration.

18. The microelectromechanical switch according to claim 16, wherein the total area of the switch is about 0.43 $mm^2$.

19. The microelectromechanical switch according to claim 1, comprising at least four second ports and at least four cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, wherein the switch exhibits one of:

return loss of at least about 20 dB, isolation of at least about 30 dB, and insertion loss of at most about 0.26 dB at one or more frequencies up to about 20 GHz for a lateral switch configuration; and return loss of at least about 18 dB, isolation of at least about 20 dB, and insertion loss of at most about 0.43 dB at one or more frequencies up to about 12 GHz for an out-of-plane switch configuration; and a total area of about 0.51 $mm^2$.

20. The microelectromechanical switch according to claim 1, comprising at least six second ports and at least six cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, the switch having at least one of:

return loss of at least about 18 dB, isolation of at least about 17.5 dB, and insertion loss of at most about 0.78 dB at one or more frequencies up to about 12 GHz for an out-of-plane switch configuration; and a total area of about 0.58 $mm^2$.

21. The microelectromechanical switch according to claim 1, comprising at least seven second ports and at least seven cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, wherein the switch exhibits one of:

return loss of at least about 19 dB, isolation of at least about 20 dB, and insertion loss of at most about 0.36 dB at one or more frequencies up to about 20 GHz for a lateral switch configuration;

return loss of at least about 19 dB, isolation of at least about 17.6 dB, and insertion loss of at most about 0.88 dB at one or more frequencies up to about 12 GHz for an out-of-plane switch configuration; and a total area of the switch is about 0.64 $mm^2$.

22. The microelectromechanical switch according to claim 1, comprising at least eight second ports and at least eight cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, the switch having at least one of:

return loss of at least about 15 dB, isolation of at least about 17 dB, and insertion loss of at most about 1.0 dB at one or more frequencies up to about 12 GHz for an out-of-plane switch configuration; and a total area of about 0.68 $mm^2$.

23. The microelectromechanical switch according to claim 1, comprising at least ten second ports and at least ten cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, the switch having at least one of:

return loss of at least about 14.7 dB, isolation of at least about 17 dB, and insertion loss of at most about 1.5 dB at one or more frequencies up to about 12 GHz for an out-of-plane switch configuration; and a total area of about 0.83 $mm^2$.

24. The microelectromechanical switch according to claim 1, comprising at least eleven second ports and at least eleven cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, the switch having at least one of:

return loss of at most about 15 dB, isolation of at least about 17 dB, and insertion loss of at least about 1.8 dB at one or more frequencies up to about 12 GHz for an out-of-plane switch configuration; and a total area of about 0.92 $mm^2$.

25. The microelectromechanical switch according to claim 1, comprising at least fourteen second ports and at least fourteen cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, the switch having at least one of:

return loss of at least about 14 dB, isolation of at least about 14 dB, and insertion loss of at most about 2.2 dB at one or more frequencies up to about 12 GHz for an out-of-plane switch configuration; and a total area of about 1.2 $mm^2$.

26. The microelectromechanical switch according to claim 1, comprising at least sixteen second ports and at least sixteen cantilever beams, a first end of each cantilever beam in contact with a corresponding one of the second ports, and a second end of each cantilever beam switchably connectable to a common junction of the first port, and wherein each cantilever beam is connected to a respective mechanical spring, the mechanical spring providing a mechanical force to move the cantilever beam connected thereto towards or away from the common junction, the switch having at least one of:

return loss of at least about 14 dB, isolation of at least about 14 dB, and insertion loss of at most about 1.9 dB at one or more frequencies up to about 26 GHz for an out-of-plane switch configuration; and a total area of about 2.5 $mm^2$.

27. The microelectromechanical switch according to claim 26, wherein the common junction of the first port comprises a plurality of spokes extending radially therefrom, each spoke switchably connectable to the second end of a respective cantilever beam, wherein the spokes are evenly distributed around the common junction such that each pair of adjacent spokes form a common angle.

28. The microelectromechanical switch according to claim 1, wherein the mechanical spring is configured to be compressed in a direction perpendicular to a length of the cantilever beam extending from the first end toward a second end.

29. The microelectromechanical switch according to claim 1, wherein the cantilever beam provides the microelectromechanical switch with a degree of freedom in a direction in which the cantilever beam moves, and wherein the mechanical spring provides the microelectromechanical switch with an additional degree of freedom in the direction in which the cantilever beam moves.

30. A switching network comprising:

a first microelectromechanical switch comprising:

a first port;

one or more second ports;

a first cantilever beam, having a first end in contact with either the first port or one of the second ports, and extending from the first end toward a second end that is switchably connectable to the other of said first port and said one of the second ports; and a first mechanical spring, connected to the first cantilever beam, for providing a mechanical force to move the first cantilever beam, wherein the first mechanical spring is a compression spring; and a second microelectromechanical switch comprising:

a third port;

one or more fourth ports;

a second cantilever beam, having a first end in contact with either the third port or one of the fourth ports, and extending from the first end toward a second end that is switchably connectable to the other of said third port and said one of the fourth ports; and a second mechanical spring, connected to the second cantilever beam, for providing a mechanical force to move the second cantilever beam, wherein the second mechanical spring is a compression spring.

31. A switching network according to claim 28, wherein each of the first microelectromechanical switch comprises at least two second ports, wherein the first end of the first cantilever beam is in contact with the first port, and the second end of the first cantilever beam is switchably connectable to each of said two second ports, and wherein the first cantilever beam is connected to the first compression spring and at least one additional compression spring, each compression spring providing a mechanical force to move the first cantilever beam towards or away from a respective one of said two second ports, and wherein the second microelectromechanical switch comprises at least two fourth ports, wherein the first end of the second cantilever beam is in contact with the third port, and the second end of the second cantilever beam is switchably connectable to each of said two fourth ports, and wherein the second cantilever beam is connected to the second compression spring and at least one additional compression spring, each compression spring providing a mechanical force to move the second cantilever beam towards or away from a respective one of said two fourth ports.

32. The switching network according to claim 30, wherein the switching network is configured to operate at a frequency of up to about 20 GHz.

33. The switching network according to claim 30, wherein the switching network is configured to operate at a frequency of up to about 26 GHz.

34. A switch comprising:

a first terminal;

a second terminal;

a deflectable beam connected to the first terminal, wherein the beam is configured to deflect towards the second terminal, wherein the beam contacts the second terminal when deflected in the direction of the second terminal;

a first electrode affixed to the beam;

a second electrode spaced apart from the first electrode, wherein a voltage applied to the second electrode causes the first electrode to move towards or away from the second electrode; and a mechanical spring affixed to the first electrode, the mechanical spring having each of a compressed state and an at-rest state, wherein the mechanical spring is in the compressed state when the first electrode moves towards the second electrode, and returns to the at-rest state when the first electrode moves away from the second electrode.

35. The switch as recited in claim 34, wherein the mechanical spring provides a force to deflect the beam towards the second terminal.

36. The switch as recited in claim 34, wherein the mechanical spring provides a force to deflect the beam away from the second terminal.

37. The switch as recited in claim 34, wherein the first and second electrodes are spaced farther apart from one another than the first and second terminals are spaced apart.

* * * * *